US006653060B2

(12) United States Patent
Nishio

(10) Patent No.: US 6,653,060 B2
(45) Date of Patent: Nov. 25, 2003

(54) METHOD OF PROCESSING SILVER HALIDE PHOTOGRAPHIC LIGHT SENSITIVE MATERIAL

(75) Inventor: Shoji Nishio, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/729,839

(22) Filed: Dec. 6, 2000

(65) Prior Publication Data

US 2001/0026908 A1 Oct. 4, 2001

(30) Foreign Application Priority Data

Dec. 8, 1999 (JP) ..... 11-348641
Dec. 8, 1999 (JP) ..... 11-348642

(51) Int. Cl.[7] ..... G03C 5/305; G03C 5/38
(52) U.S. Cl. ..... 430/488; 430/455
(58) Field of Search ..... 430/488, 455

(56) References Cited

U.S. PATENT DOCUMENTS 5,683,859 A * 11/1997 Nothnagle et al. ..... 430/488
5,830,626 A * 11/1998 McGuckin et al. ..... 430/488
5,932,390 A * 8/1999 Ishigaki et al. ..... 430/434
5,972,577 A * 10/1999 Komatsu et al. ..... 430/455
5,972,580 A * 10/1999 Fukui et al. ..... 430/488
5,976,758 A * 11/1999 Fukui et al. ..... 430/488

FOREIGN PATENT DOCUMENTS

EP 0809147 11/1997
EP 0939337 9/1999

OTHER PUBLICATIONS

European Search Report EP 00 12 6430.

* cited by examiner

*Primary Examiner*—Hoa Van Le

(74) *Attorney, Agent, or Firm*—Muserlian, Lucas and Mercanti, LLP

(57) ABSTRACT

A method for processing a silver halide light-sensitive material employing an automatic processing machine is disclosed. A developer comprises compounds represented by the formula (1), and a fixer comprises thiosulfate salts, water-soluble aluminum salts, and at least one type of crystallization retarding agents and substantially comprises no boron compound.

General Formula (1)

wherein Q represents —$CH_2CH_2$— or —$CH_2CH(J)$—, wherein J represents a hydrogen atom or an alkyl group. x+y+Z is between 2.8 and 3.2, and R represents the group described below.

Staining of the water washing tank and processing unevenness caused by a decrease in the replenishment rate of a fixer, are minimized during photographic processing employing an automatic processing machine.

11 Claims, No Drawings

METHOD OF PROCESSING SILVER HALIDE PHOTOGRAPHIC LIGHT SENSITIVE MATERIAL

The present invention relates to a method for processing a silver halide light-sensitive photographic material (hereinafter occasionally referred to as a light-sensitive material), and to a method for processing a silver halide light-sensitive photographic material which is subjected to minimized processing unevenness during running processing.

After imagewise exposure, black-and-white silver halide light-sensitive photographic materials are generally processed employing steps consisting of development, fixing, water washing, and drying. Of said steps, it is generally carried out that in the fixing step, by processing said light-sensitive materials employing a fixer comprising a water-soluble aluminum salt (a so-called hardening fixer), the drying time is shortened by hardening the layer of said light-sensitive materials and thus the conveyance of said light-sensitive materials is improved in an automatic processing machine (hereinafter occasionally referred to as an automatic processor).

Incidentally, for the past few years, from the viewpoint of environmental safety, a decrease in the effluent volume of processing solutions has been demanded. From the viewpoint of a decrease in the processing cost of said effluent, the decrease of said effluent is preferred. However, when the replenishment rate of a fixer is decreased, problems have occurred in which when a silver halide light-sensitive material is conveyed to a fixing tank from a developer tank, development is not stopped uniformly in the fixer, and as a result, the density of black silver formed in the exposed area is not uniform. Said adverse fact has hindered achievement of low replenishment rate of said fixer.

Further, when the pH is raised, said hardening fixer, comprising water-soluble aluminum compounds, forms sparingly soluble aluminum salts. In order to minimize the formation of said sparingly soluble salts, the pH may be lowered. However, since thiosulfate salts are incorporated as the fixing agent, a problem occurs in which the fixing agent undergoes sulfurization. Due to said fact, the fixer is generally employed in the range of a pH of 4.2 to 5.4. However, in said pH range, it is impossible to hinder the formation of sparing soluble aluminum compounds. Specifically, when the replenishment rate of a fixer is decreased as described above, the formation of sparingly soluble aluminum compounds is adversely affected. In order to overcome these drawbacks, a large amount of boron compounds is commonly employed. Said boron compounds are carried over to the water washing tank by the light-sensitive material and so-called eutrophication tends to result and scale staining of the water washing tank also results. On the other hand, it has been known that boron compounds may be replaced with organic acids. For example, Research Disclosure (hereinafter referred to as RD) 18728 discloses an example in which organic acids such as gluconic acid, glycolic acid, and the like, are employed instead of boron compounds. In others, such as RD 16768, Japanese Patent Publication Open to Public Inspection (abbreviated as JP O.P.I.) No. 63-284546, and the like, examples are described in which organic acids are employed as the substitutes. However, processing unevenness is not sufficiently improved, and thus more improvement is demanded.

Further, the decrease in the replenishment rate results in various problems. For instance, silver from silver halide light-sensitive photographic materials (hereinafter occasionally referred to as light-sensitive materials) deposits in the development tank of automatic processing machines, and the deposited silver adheres onto the conveyance rollers, so that the adhered silver is transferred onto the silver halide light-sensitive photographic material, resulting in staining. For the purpose of minimizing such staining, JP O.P.I. No. (abbreviated as JP O.P.I.) No. 11-149142 describes a means in which the silver stain is decreased by adding a certain compound to a developer. Incidentally, current replenishers are supplied in a concentrated solution form. When photographic processing was carried out employing a replenisher which was prepared by using a concentrated solution comprising the aforementioned compound, problems occurred in which the sensitivity decreased during running processing and oily sludge adhered onto the silver halide light-sensitive photographic materials.

In order to overcome said problems, the inventors of the present invention have investigated the supply employing a solid developer and have been able to overcome the problems.

SUMMARY OF THE INVENTION

It is an object of the present invention to provide a method for processing a silver halide light-sensitive photographic material in which silver stain (black spots) caused by a decrease in the replenishment rate, and further a decrease in sensitivity as well as oily sludge adhesion, which is caused by photographic processing during running processing employing a replenisher prepared by employing a usual concentrated solution is minimized.

It is another object of the present invention to provide a method for processing a silver halide light-sensitive photographic material in which during photographic processing employing an automatic processing machine, staining of the water washing tank, as well as processing unevenness which is generated by a decrease in the replenishment rate of a fixer, is minimized.

The object of the present invention has been achieved by employing the embodiments described below.

A method for processing a silver halide light-sensitive photographic material employing an automatic processing machine comprising steps of developing an exposed silver halide light-sensitive photographic material with developer, fixing the developed silver halide light-sensitive photographic material with fixer, washing the fixed silver halide light-sensitive photographic material with washing water, and drying the washed silver halide light-sensitive photographic material, wherein the developer comprises compounds represented by formula (1), and the fixer comprises thiosulfate salts, water-soluble aluminum salts, and at least one type of crystallization retarding agents and substantially comprises no boron compound.

Formula (1)

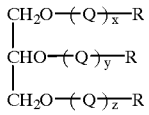

wherein Q represents —$CH_2CH_2$— or —$CH_2CH(J)$—, and J represents a hydrogen atom, sum of x, y and z is 2 to 4, and R represents

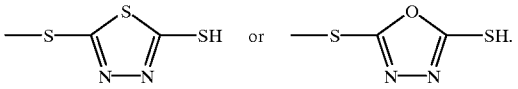

The preferable examples of the crystallization retarding agent are gluconic acid, glycolic acid, maleic acid, imidinoacetic acid, and 5-sulfosalicyclic acid, and their derivatives, salt of gluconic acid, glycolic acid, maleic acid, imidinoacetic acid, and 5-sulfosalicyclic acid, and their derivatives.

The developer preferably comprises hydroquinone as a developing agent.

In the another embodiment, the developer preferably comprises ascorbic acid or its salt as a developing agent.

In the other embodiment, the developer preferably comprises 3-pyrazolidone or aminophenol compound as the development aid.

The silver halide light-sensitive photographic material preferably comprises a hydrazine compound and a nucleation promoting agent.

The silver halide light-sensitive photographic material preferably comprises a quaternary onium compound.

The fixer is replenished with a fixer replenisher at replenishment rate of 400 ml/$m^2$ or less.

The developer is preferably replenished with a developer replenisher, which comprises a compound represented by formula (1) and is prepared by employing a solid developer.

The replenishment rate of the developer replenisher is preferably 250 ml/$m^2$ or less.

The developer replenisher comprises carbonate salt of 0.5 mole/liter or less preferably.

The other embodiments are described.

(1) In a method for processing a silver halide light-sensitive photographic material employing an automatic processing machine which comprises a development process, a fixing process, a water washing process, and a drying process, a method for processing a silver halide light-sensitive photographic material characterized in that a developer comprises compounds represented by the general formula (1) described below, and a fixer comprises thiosulfate salts, water-soluble aluminum salts, and at least one type of crystallization retarding agents and substantially comprises no boron compound.

(1)

General Formula (1)

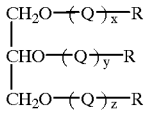

wherein Q represents —$CH_2CH_2$— or —$CH_2CH(J)$—, and J represents a hydrogen atom. x+y+z is between 2.8 and 3.2, and R represents a substituent described below:

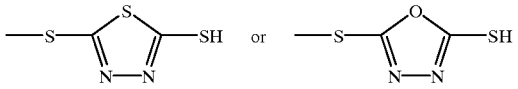

(2) The method for processing silver halide light-sensitive photographic material described in (1) above, characterized in that said crystallization retarder is selected from gluconic acid, glycolic acid, maleic acid, imidinoacetic acid, and 5-sulfosalicyclic acid, and their derivatives, as well as salts thereof.

(3) The method for processing a silver halide light-sensitive photographic material described in (1) or (2) above, characterized in that a developer comprises hydroquinone as the developing agent, and at least one of 3-pyrazolidones or aminophenols as the development aid.

(4) The method for processing a silver halide light-sensitive photographic material described in (1) or (2) above, characterized in that a developer comprises ascorbic acid or salts thereof, and at least one of 3-pyrazolidone or a aminophenols, as the developing aid agent.

(5) The method for processing a silver halide light sensitive photographic material described in (1), (2), (3), or (4) above, characterized in that said silver halide light-sensitive photographic material comprises a hydrazine compound and a nucleation promoting agent.

(6) The method for processing a silver halide light-sensitive photographic material described in (1), (2),(3), or (4) above, characterized in that said silver halide light-sensitive photographic material comprises a quaternary onium compound.

(7) The method for processing a silver halide light-sensitive photographic material described in (1), (2), (3), (4), (5), or (6) above, characterized in that the replenishment rate of a fixer is 400 ml/$m^2$ or less.

(1) In a method for processing a silver halide light-sensitive material in which an automatic processing machine is employed and a developer replenisher is supplied, a method for processing a silver halide photographic material characterized in that said developer replenisher comprises a compound represented by the general formula (1) described below and said developer replenisher is prepared by employing a solid developer.

General Formula (1)

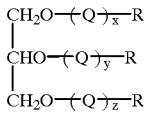

wherein Q represents —$CH_2CH_2$— or —$CH_2CH(J)$—, wherein J represents a hydrogen atom or an alkyl group. x+y+Z is between 2.8 and 3.2, and R represents the group described below.

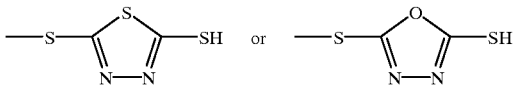

(2) The method for processing a silver halide light-sensitive photographic material described in (1) above, characterized in that a developer replenisher comprises hydroquinone as the developing agent and at least one of 3-pyrazolidones or aminophenols as the development aid.

(3) The method for processing a silver halide light-sensitive photographic material described in (1) above, characterized in that a developer replenisher comprises ascorbic acid or salts thereof as the developing agent as well as at least one of 3-pyrazolidones or aminophenols as the development aid.

(4) The method for processing a silver halide light-sensitive photographic material described in (1), (2), or (3) above, characterized in that said silver halide light-sensitive photographic material comprises a hydrazine compound as well as a nucleation promoting agent.

(5) The method for processing a silver halide light-sensitive photographic material described in (1), (2), or (3) above, characterized in that said silver halide light-sensitive photographic material comprises a quaternary onium compound a hydrazine compound as well as a nucleation promoting agent.

(6) The method for processing a silver halide light-sensitive photographic material described in (1), (2), (3), (4), or (5) above, characterized in that the replenishment rate of the developer replenisher is 250 ml/m$^2$ or less.

(7) The method for processing a silver halide light-sensitive photographic material described in (1), (2), (3), (4), (5), or (6) above, characterized in that the carbonate salt concentration of said developer replenisher is 0.5 mole/liter or less.

DETAILED DESCRIPTION OF PREFERRED EMBODIMENT

The present invention will now be detailed below.

The method for processing a silver halide light-sensitive photographic material employing an automatic processing machine comprising steps of, developing an exposed silver halide light-sensitive photographic material with developer, fixing the developed silver halide light-sensitive photographic material with fixer, washing the fixed silver halide light-sensitive photographic material with washing water, and drying the washed silver halide light-sensitive photographic material.

The developer comprises a compound represented by formul (1). The fixer comprises thiosulfate salts, and at least one of crystallization retarding agents and water-soluble aluminum salts, and substantially comprises no boron compound.

In the processing method of the present invention, in order to decrease the effluent amount, processing is carried out while providing replenishers to the development process as well as to the fixing process at a constant amount which is proportional to the area of the light-sensitive material to be processes.

The fixer comprises thiosulfate salts, and at least one of crystallization retarding agents and water-soluble aluminum salts, and substantially comprises no boron compound.

Into the fixer of the present invention, incorporated are water-soluble aluminum salts such as, for example, potassium alum, ammonium alum, sintered alum, sintered ammonium alum, aluminum chloride, aluminum potassium chloride, aluminum sulfate, and the like.

The fixer of the invention comprises water-soluble aluminum salt, at least one of crystallization retarders and thiosulfate, but not a boron compound substantially.

Specifically employed as thiosulfate salts of the present invention are salts of lithium, potassium, sodium, and ammonium. However, when ammonium thiosulfate and sodium thiosulfate are employed, it is possible to obtain a fixer which exhibits a high rate of fixing.

If desired, incorporated into fixing agents and/or fixer replenishing agents may be compounds such as preservatives (for example, sulfite salts, bisulfite salts), pH buffer agents (for example, acetic acid and citric acid), pH regulators (for example, sulfuric acid), chelating agents having water softening capability other than compounds of the present invention, silver sludge minimizing agents (for example, nitrogen containing heterocyclic ring compounds having a mercapto group such as 1-phenyl-5-mercaptotetrazole), silver image tone control agents (for example, 2,5-dimercapto-1,3,5-thiadiazole), and the like. "Substantially containing no boron compound" as described herein means that the concentration in a fixer is 0.04 mole/liter or less.

In the general formula (1), the alkyl group represented by J is preferably a lower alkyl group having at most 4 carbon atoms, and specifically methyl and ethyl may be cited.

Compounds represented by the general formula (1) generally have a molecular weight of 400 to 6,000, and preferably have a molecular weight of 450 to 5,000: The content of said compounds in the developer and developer replenisher is at least 0.005 g/liter, is preferably at least 0.008 g/liter, is more preferably at least 0.01 g/liter. The maximum content is 0.2 g/liter, the content is preferably 0.1 g/liter, and is more preferably 0.05 g/liter.

In the formula (1), sum of x, y and z is 2 to 4. Preferably all of x, y and z is 1, two of x, y and z is 1 and the other is 0, or two of x, y and z is 1 and the other is 2. The particularly preferable case is that all of x, y and z is 1.

When the compound represented by the formula (1) is detected from the developer or developing replenisher which contains a plurality of the compounds represented by the formula (1), it is difficult to detect the individual compound separately and it is usual that a plurality of the compounds is detected as a whole. In this instance, detected value of the sum of x, y and z gives frequently average value of these compounds, for example, 2.8 to 3.2, as shown in the list.

Specific compounds represented by the formula (1) are listed below.

Compound of Formula (1)

| | J | R | x + y + z |
|---|---|---|---|
| (1)-1 | H | 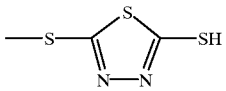 | 2.8–3.2 Preferably 3 |
| (1)-2 | H | 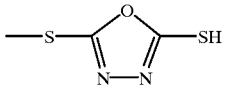 | 2.8–3.2 Preferably 3 |
| (1)-3 | $CH_3$ | 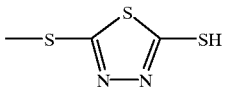 | 2.8–3.2 Preferably 3 |
| (1)-4 | $C_2H_5$ | 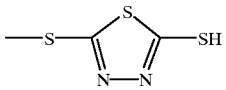 | 2.8–3.2 Preferably 3 |

-continued

| Compound of Formula (1) | | | |
|---|---|---|---|
| | J | R | x + y + z |
| (1)-5 | $C_2H_5$ | 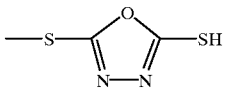 | 2.8–3.2 Preferably 3 |
| (1)-6 | $CH_3$ | 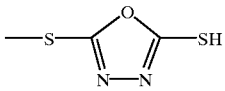 | 2.8–3.2 Preferably 3 |

Crystallization retarders in the present invention mean compounds which retard the formation of sparingly soluble aluminum compounds in a fixer comprising aluminum salts, specifically indicate the compounds described in RD 18728 and are preferably organic acids described in JP O.P.I. No. 8-29929. Specifically preferable compounds include gluconic acid, glycolic acid, maleic acid, imidinoacetic acid, 5-sulfosalicylic acid, and their derivatives, and salts thereof. The most preferable compounds include gluconic acid and imidinoacetic acid, and derivatives, as well as salts thereof.

The added amount of these compounds is between 0.005 and 0.2 mole/liter in a single agent type hardening fixer substantially comprising no boron compound, and is preferably between 0.005 and 0.1 mole/liter. These compounds may be employed individually or in combination of two or more types. Further, it is preferable that these are employed together with organic acids such as tartaric acid, citric acid, cinnamic acid, salicylic acid, ascorbic acid, erythorbic acid, and the like, and aminopolycaroboxylic acid and sugars such as glycine, ethylenediaminetetraacetic acid, diethylenetriaminepentaacetic acid, nitrilotriacetic acid, and the like.

In the present invention, the replenishment rate of a fixer is 400 ml/$m^2$ or less, and preferably 50 to 400 ml/$m^2$, and particularly 100 to 300 ml/$m^2$. When the replenishment rate is controlled in the preferable amount, films can be processed with constant pH, the drying properties of the films can be maintained appropriately, while the effluent amount can be minimize.

Ascorbic acid and salt thereof, which functions as the developing agent contained in the developer of the invention, include analogue compounds, isomer and the derivative thereof. It is known to use the ascorbic acid as the developing agent in the photographic field. The examples include L-ascorbic acid, D-ascorbic acid, L-erythroascorbic acid, D-glucoascorbic acid, 6-deoxy-L-ascorbic acid, L-rhamnoascorbic acid, D-glucoheptaascorbic acid, imino-L-erythroascorbic acid, imino-D-glucoascorbic acid, imino-6-deoxy-L-ascorbic acid, imino-D-glucoheptaascorbic acid, sodium isoascorbate, L-glucoascorbic acid, D-galactoseascorbic acid, L-araboascorbic acid, sorboascorbic acid, sodium ascorbate and other compound obvious compound for a person skilled in the art. It is not restrict to these.

The hydrazine derivative working as a contrast enhancing agent includes those represented by the following formula (H).

Formula (H)

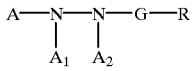

wherein A is an aryl group or a heterocyclic group containing an oxygen atom or a sulfur atom; G is —(CO)n—, sulfonyl group, sulfoxy group, —P(=O)$R_{52}$—, or iminomethylene group, and n is an integer of 1 or 2, $A_1$ and $A_2$ are both hydrogen atoms, or either of them is a hydrogen atom and the other is a substituted or unsubstituted alkylsulfonyl group or a substituted or unsubstituted acyl group; R is a hydrogen atom or a substituted or unsubstituted alkyl, alkenyl, aryl, alkoxy, alkenyloxy, aryloxy, heterocyclic-oxy, amino, carbamoyl group or oxycarbonyl group; $R_{52}$ is a substituted or unsubstituted alkyl, alkenyl, alkynyl, aryl, alkoxy, alkenyloxy, alkynyloxy, aryloxy or amino group.

Of the compounds represented by formula (H), a compound represented by the following formula (Ha) is preferred:

formula (Ha)

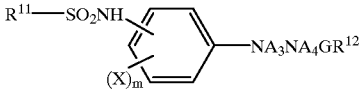

wherein R is an aliphatic group (e.g., octyl, decyl), an aromatic group (e.g., phenyl, 2-hydroxyphenyl, chlorophenyl), or a heterocyclic group (e.g., pyridyl, thienyl, furyl), each of which may be substituted. Specifically, $R^{11}$ having a ballast group or a group promoting adsorption onto silver halide is preferred.

The ballast group is preferably one which are commonly used in non-diffusible photographic additives such as couplers, and having 8 or less carbon atoms, such as alkyl, alkenyl, alkynyl, alkoxy, phenyl and alkylphenoxy.

Examples of the group promoting adsorption onto silver halide include a thiourea group, a thiourethane group, mercapto group, a thioether group, a heterocyclic group, a thioamino-heterocyclic group, a mercapto-heterocyclic group and adsorbing groups described in JP O.P.I. NO. 64-90439.

In formula (Ha), X is a group capable of being substituted on a phenyl group; m is an integer of 0 to 4, provided that when m is 2 or more, X may be the same or different.

In formula (Ha), $A_3$ and $A_4$ are the same as defined in $A_1$ and $A_2$ of formula (H) and are preferably both hydrogen atoms.

In formula (Ha), G is a carbonyl group, oxalyl group, sulfonyl group, sulfoxy group, phosphoryl or imlnomethylene group; and is preferably a carbonyl group.

In formula (Ha), $R^{12}$ is a hydrogen atom, or an alkyl group, alkenyl group, alkynyl group, aryl group or heterocyclic group, alkoxy group, amino group, carbamoyl group or oxycarbonyl group, each of which may be substituted or unsubstituted; or hydroxy. $R^{12}$ is preferably an alkyl group whose carbon atom substituted by G is substituted by at least one electron-withdrawing group, a group of —$COOR^{13}$, or $CON(R^{14})$ $(R^{15})$, in which $R^{13}$ is an alkynyl group or a saturated heterocyclic group, $R^{14}$ is a hydrogen atom, an alkyl group, alkenyl group, alkynyl group, aryl group or heterocyclic group; and $R^{15}$ is an alkenyl group, alkynyl group, saturated heterocyclic group, hydroxy group or alkoxy group. $R^{12}$ is more preferably an alkyl group whose carbon atom substituted by G is substituted by two electron-withdrawing groups and particularly preferable, three electron-withdrawing groups. The electron-withdrawing group which substitutes a carbon atom substituted by G in $R^{12}$ is one having σp of 0.2 or more and σm of 0.3 or more, and includes for example, halogen atom, cyano group, nitro group, nitrosopolyhaloalkyl group, polyhaloalkyl group, alkylcarbonyl group, arylcarbonyl group, formyl group, alkyloxycarbonyl group, aryloxycarboyl group, alkylcarbonyloxy group, carbamoyl group, alkylsulfonyloxy group, arylsulfonyloxy group, sulfamoyl group, phosphino group, phosophinoxide group, phosphonic acid ester group, phosphonicamido group, arylazo group, amidino group, ammonio group, sulfonio group and electron-deficient heterocyclic group. $R^{12}$ in Formula (Ha) is particularly preferably a fluorine-substituted alkyl group such as monofluoromethyl group, difluoromethyl group, and trifluromethyl group.

Practical examples of the compounds represented by formula (H) are shown below, but are not limited to these.

H-1

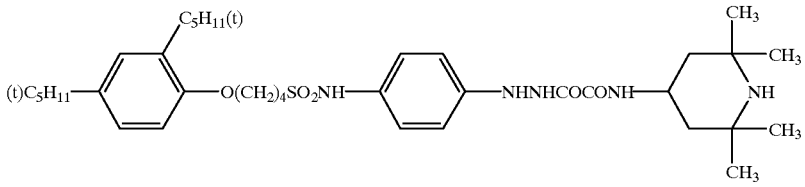

H-2

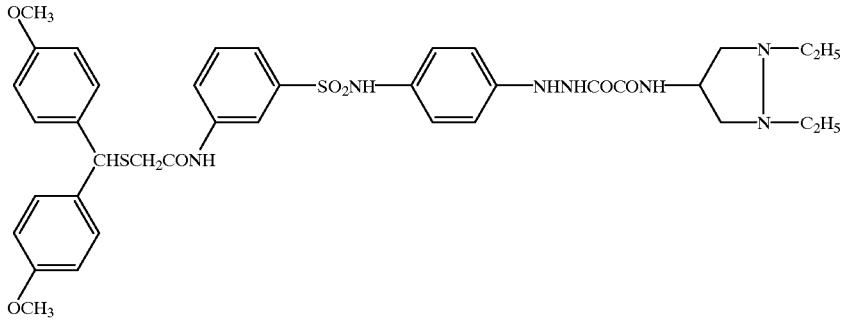

H-3

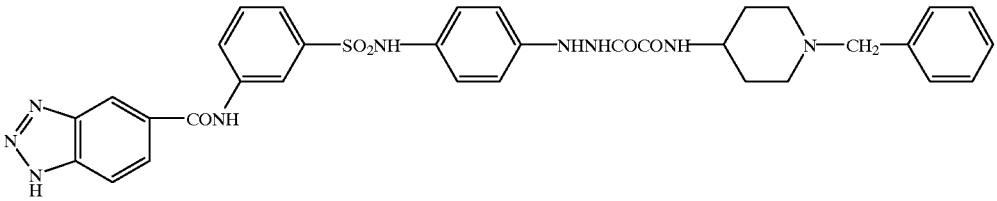

H-4

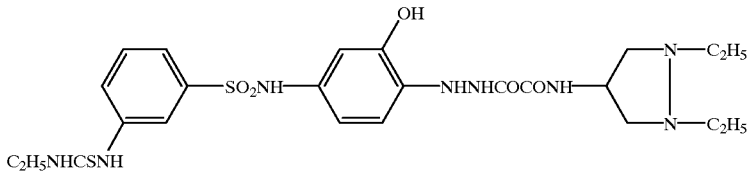

H-5

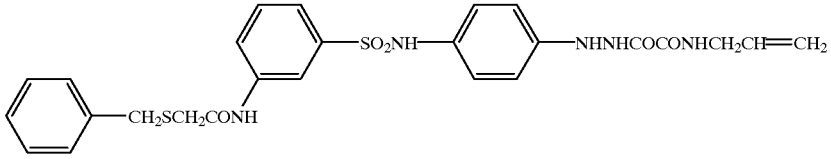

H-6

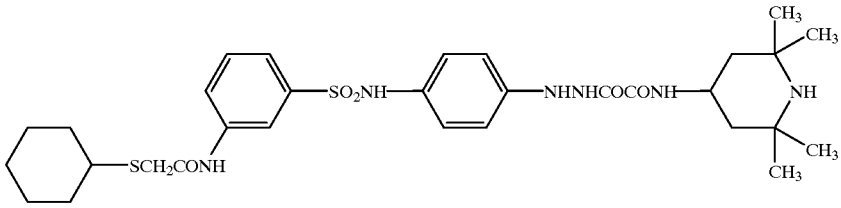

-continued
H-7
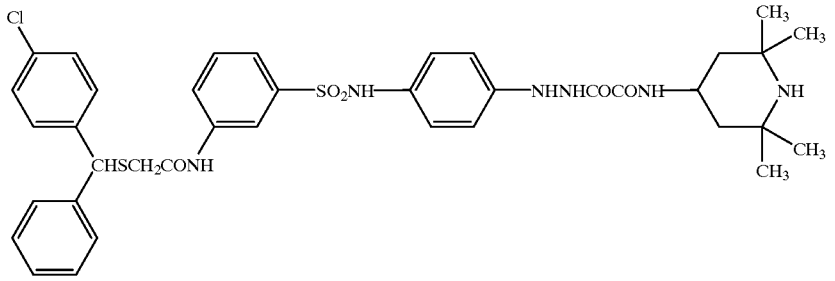
H-8
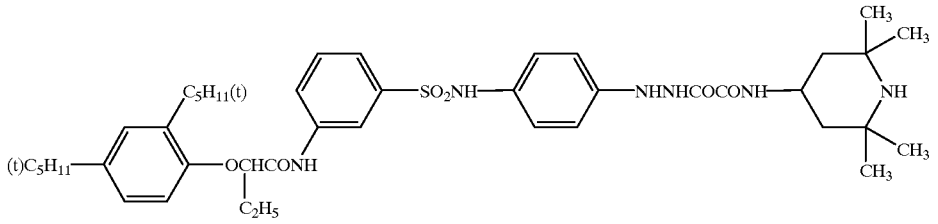
H-9
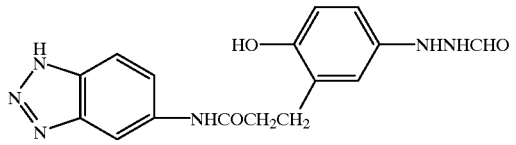
H-10
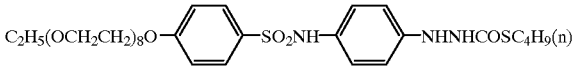
H-11
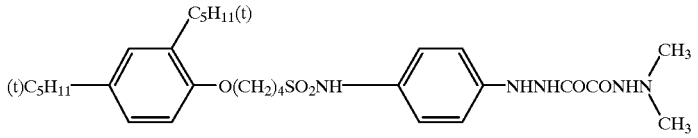
H-12
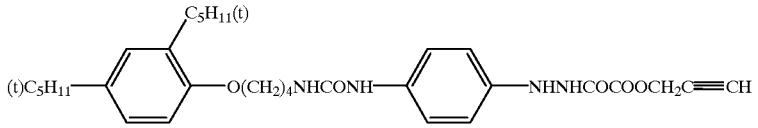
H-13
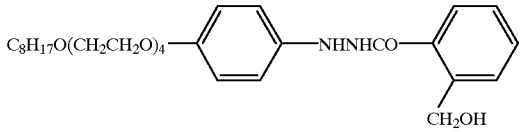
H-14
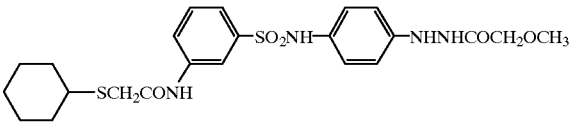
H-15
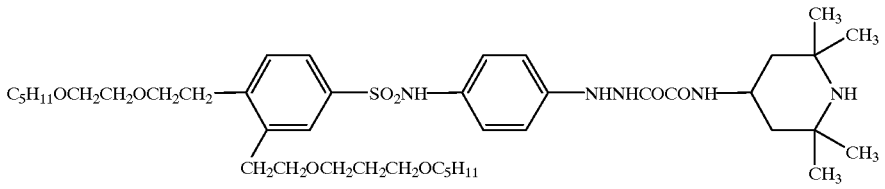
H-16
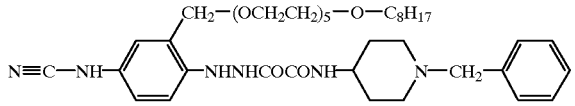
H-17
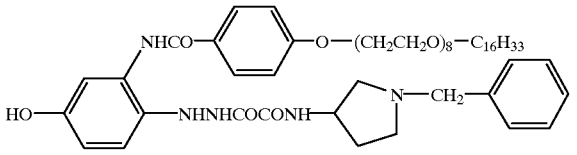

-continued
H-18
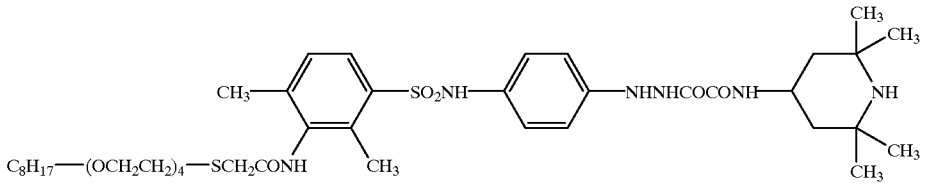
H-19
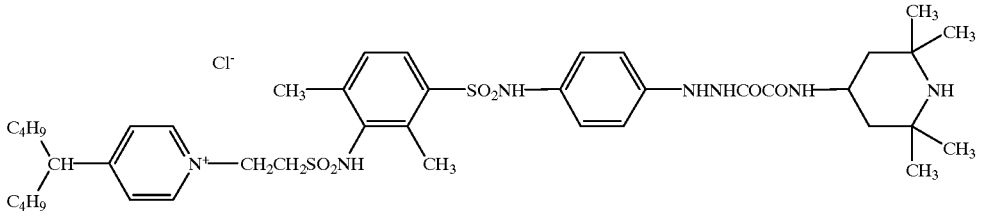
H-20
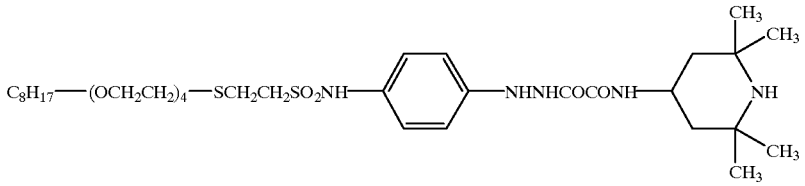
H-21
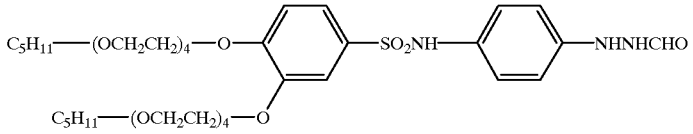
H-22
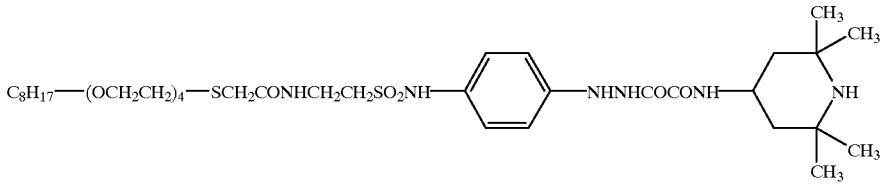
H-23
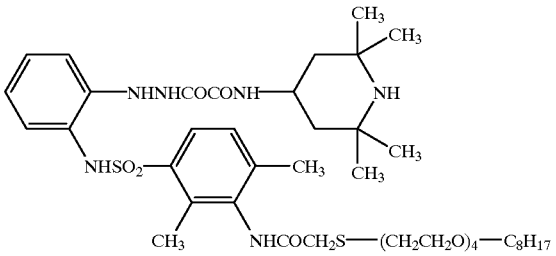
H-24
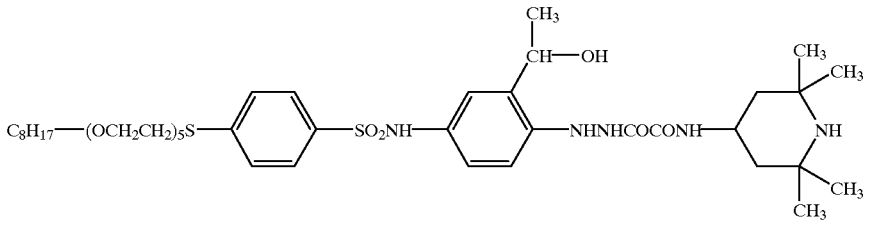

-continued
H-25
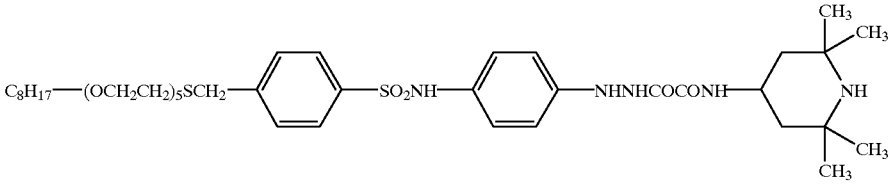
H-26
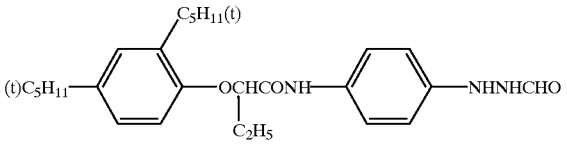
H-27
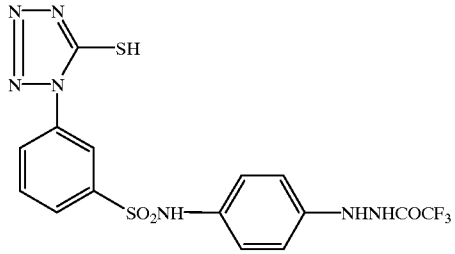
H-28
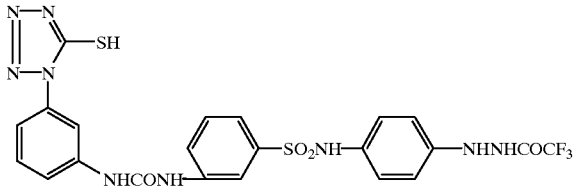
H-29
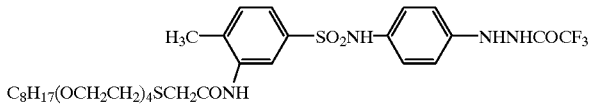
H-30
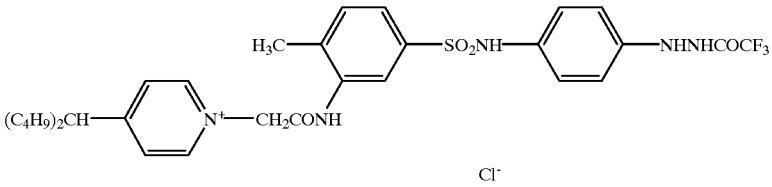
H-31
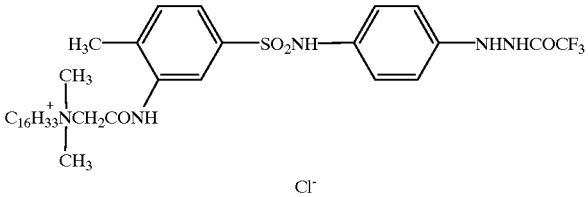
H-32
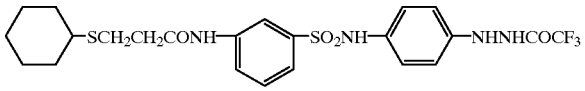
H-33
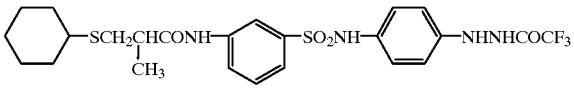
H-34
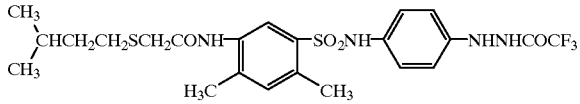
H-35
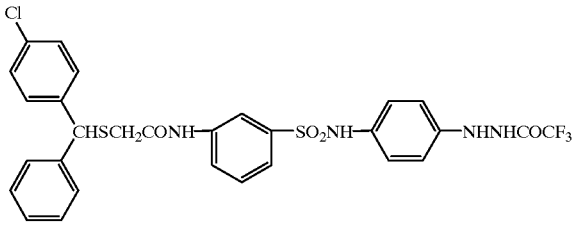
H-36
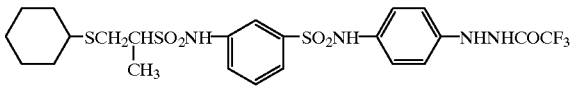

-continued
H-37
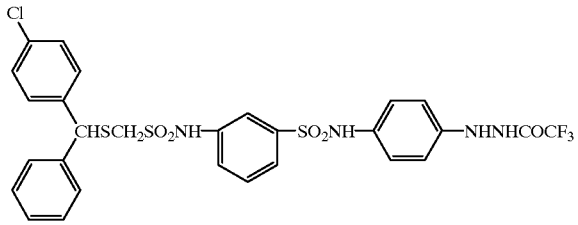
H-38
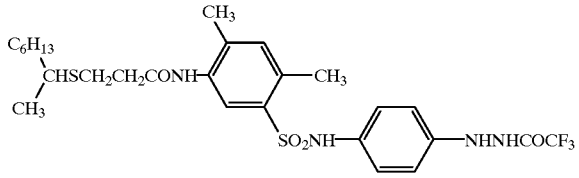
H-39
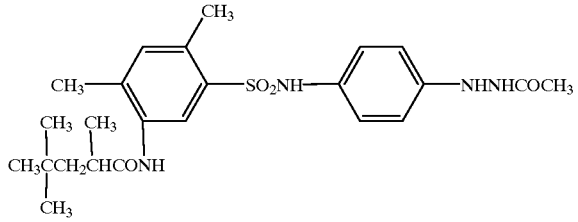
H-40
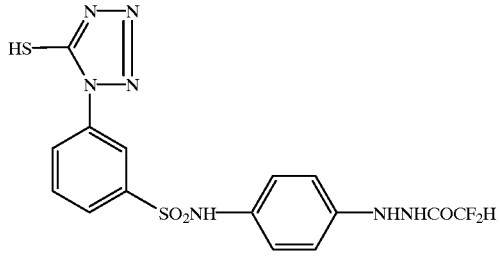
H-41
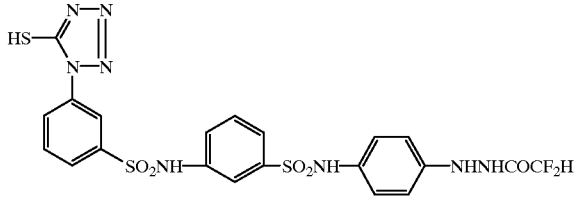
H-42
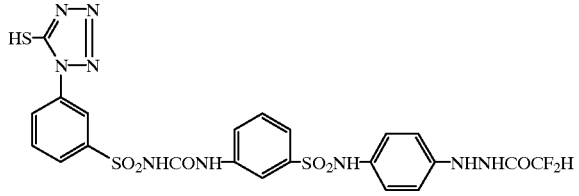
H-43
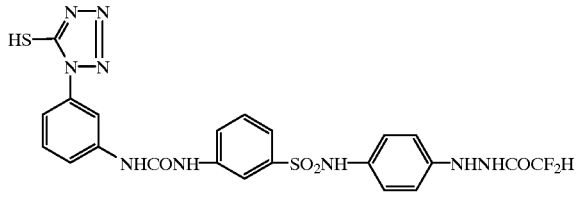
H-44
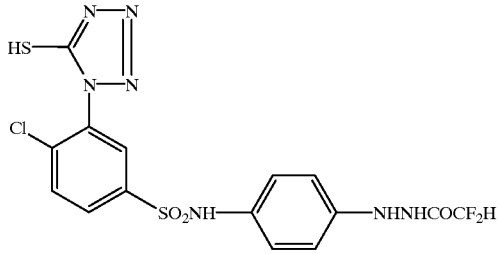
H-45
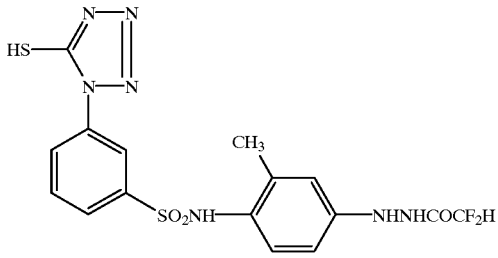
H-46
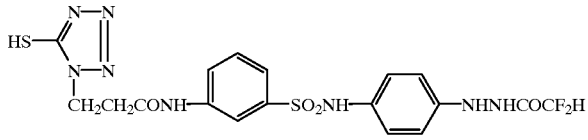
H-47
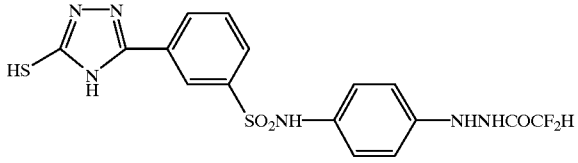
H-48
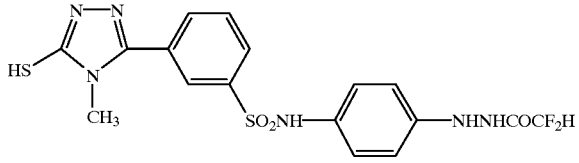

-continued
H-49
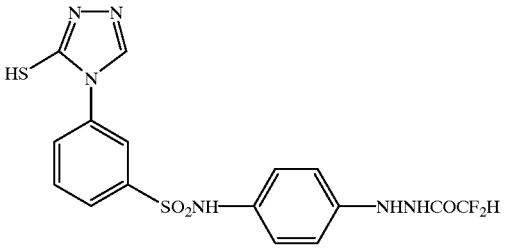
H-50
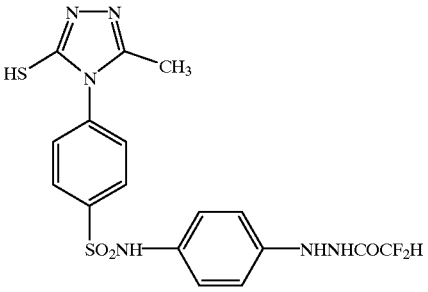
H-51
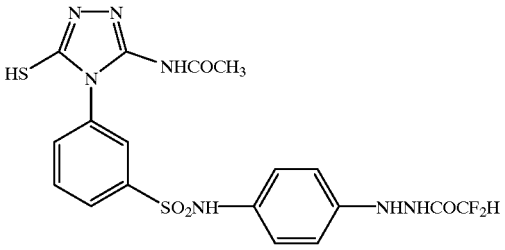
H-52
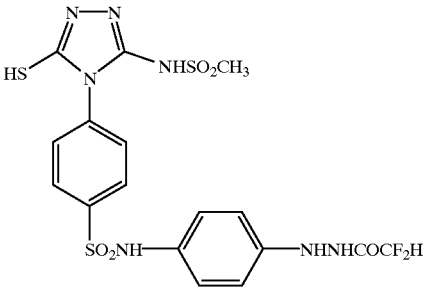
H-53
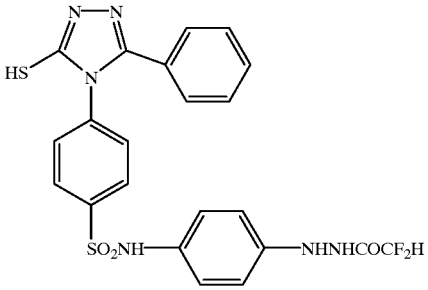
H-54
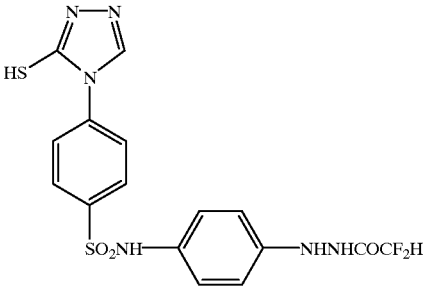
H-55
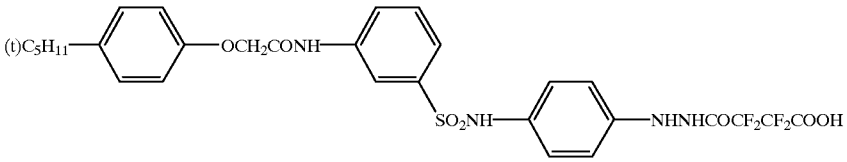
H-56
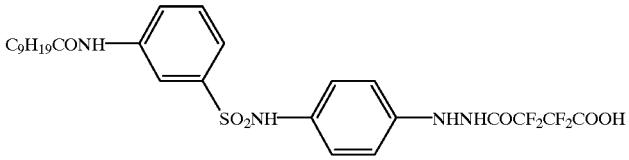
H-57
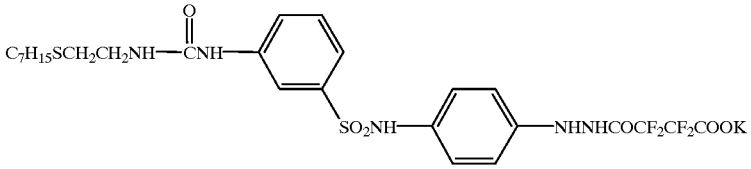

-continued

H-58

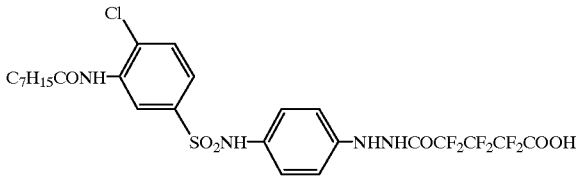

H-59

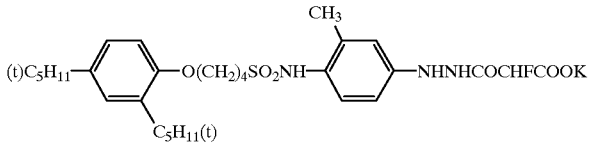

H-60

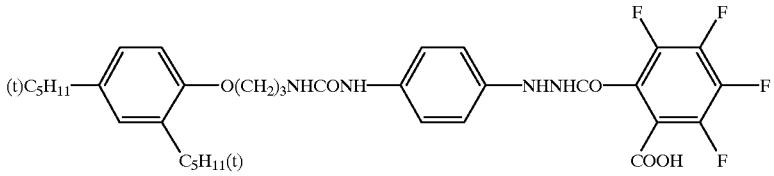

H-61

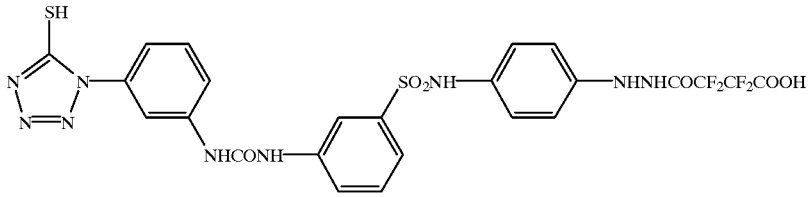

H-62

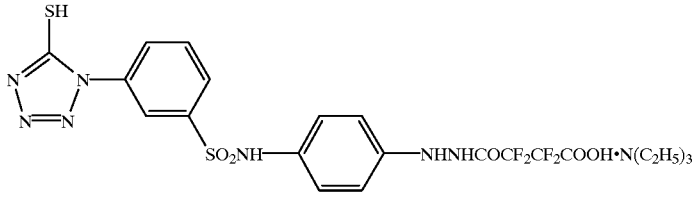

H-63

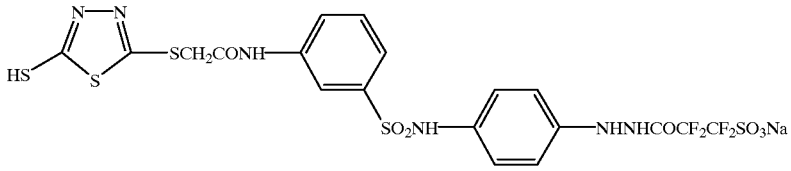

In addition, practical examples of hydrazine derivatives are described in U.S. Pat. No. 5,229,248, col. 4 through col. 60, including compounds (1) through (252).

The hydrazine compounds according to the present invention can be synthesized according to the conventionally known methods in the art. For example, they may be synthesized according to the method disclosed on columns 59 through 80 in the U.S. Pat. No. 5,229,248.

An adding amount of the hydrazine derivative may be optional if it is one capable of hardening the light-sensitive photographic material according to the present invention, and the optimum amount of addition may be varied depending on the grain size of the silver halide particles, halide composition, degree of chemical ripening and kind of restraining agent, etc., however, it is generally between $10^{-6}$ and $10^{-1}$ mol, and, more preferably, between $10^{-5}$ and $10^{-2}$ mol per one mol of silver halide. The hydrazine compound is incorporated in at least one of a layer at side of silver halide emulsion layer, preferably in the silver halide emulsion layer and/or adjacent layer, more preferably the emulsion layer. The content of the hydrazine compound in the photographic component layer closest to the support among the photographic component layer is 0.2 to 0.8 mol equivalent, more preferably 0.4 to 0.6 mol equivalent, with respect to the total content of the layers farther from the layer closest to the support. The hydrazine compound employed in the invention is one species or two or more in combination.

To effectively promote contrast-increasing by the use of the hydrazine derivatives, it is preferred to use a nucleation promoting agent.

A nucleation accelerating compound represented by the following formula (Na) or (Nb) is preferred effectively to promote contrast increasing of the hydrazine derivatives:

Formula Na

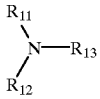

Formula Nb

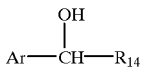

In the formula (Na) $R_{11}$, $R_{12}$ and $R_{13}$ independently represent a hydrogen atom, a substituted or unsubstituted alkyl group, a substituted or unsubstituted alkenyl group, an alkynyl group, a substituted or unsubstituted aryl group, provided that $R_{11}$, $R_{12}$ and $R_{13}$ may combine to form a ring. Of these compounds represented by formula (Na), is particularly preferable an aliphatic tertiary amine compound. It is preferable for these compounds to contain in their molecules a diffusion-proof group or a group promoting adsorption onto silver halide. In order for the diffusion-proof property to be conferred, a compound having molecular weight more than 100 is preferable, and, more advantageously, one having a molecular weight of not less than 300. Moreover as preferable group promoting adsorption onto silver halide, for example, a heterocyclic group, a mercapto group, a thioether group, a thion group, thiourea group, etc. can be mentioned. As particularly preferable compound represented by the general formula (Na), a compound having in its molecule at least one thioether group as the silver halide adsorption-accelerating group can be mentioned.

Practical examples of nucleation accelerating compound represented by the formula (Na) are given below.

Na-1

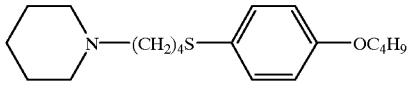

Na-2

$[(C_3H_7)_2N(CH_2)_3OCH_2CH_2]_2S$

Na-3

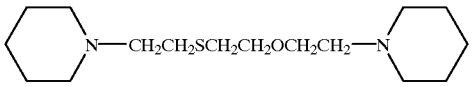

Na-4

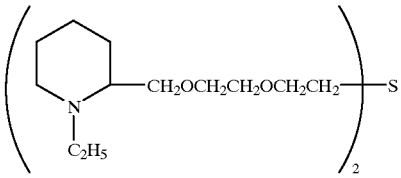

Na-5

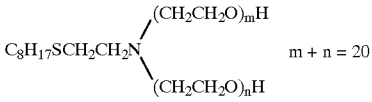

Na-6

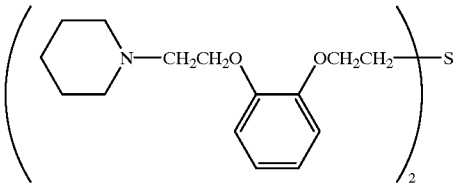

Na-7

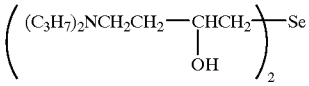

Na-8

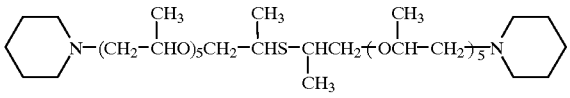

-continued

Na-9

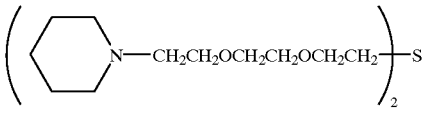

Na-10

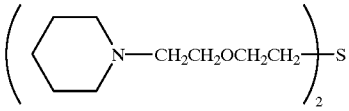

Na-11

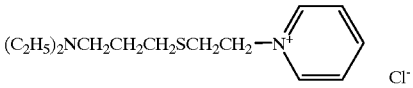

Na-12

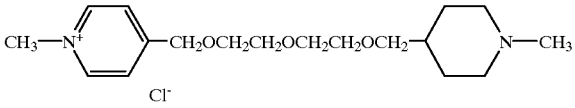

Na-13

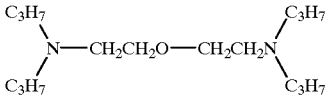

Na-14

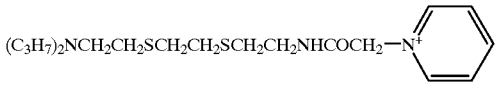

Na-15

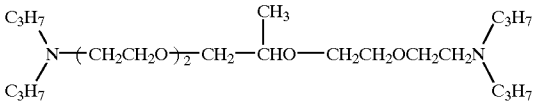

Na-16

$((C_2H_5)_2N(CH_2)_3NHCOCH_2)_2Se$

Na-17

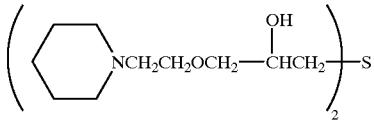

Na-18

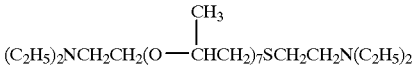

Na-19

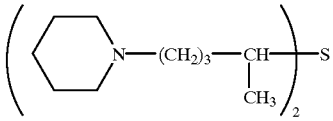

Na-20

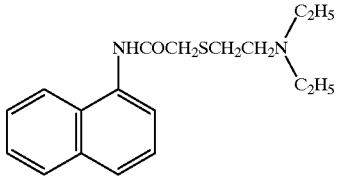

-continued

Na-21

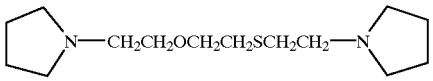

In the formula (Nb) Ar represents a substituted or unsubstituted aromatic group or a substituted or unsubstituted heterocyclic group. $R_{14}$ represent a hydrogen atom, an alkyl group, an alkynyl group, an aryl group, provided that $R_{11}$, $R_{14}$ and the aryl group may combine to form a ring. It is preferable for these compounds to contain in their molecules a diffusion-proof group or a group promoting adsorption onto silver halide. In order for the diffusion-proof property to be conferred, a compound having molecular weight more than 120 is preferable, and, more advantageously, one having a molecular weight of not less than 300. Moreover as preferable group promoting adsorption onto silver halide the same promoting adsorption group for the compound represented by formula (H) can be mentioned.

Practical examples of nucleation accelerating compound represented by the formula (Nb) are given below.

Nb-1

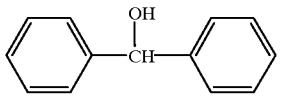

Nb-2

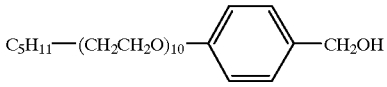

Nb-3

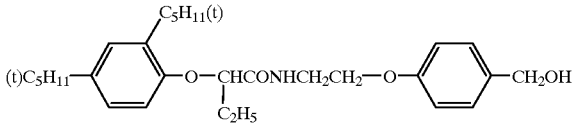

Nb-4

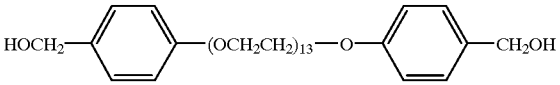

Nb-5

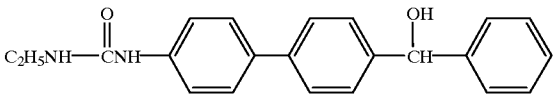

Nb-6

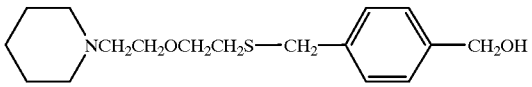

Nb-7

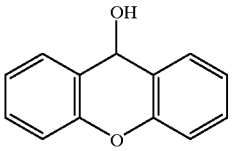

-continued

Nb-8

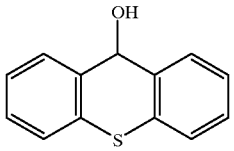

Nb-9

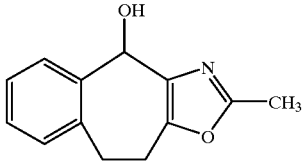

Nb-10

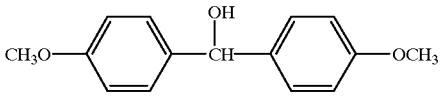

Nb-11

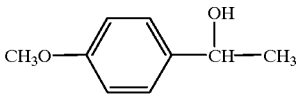

Nb-12

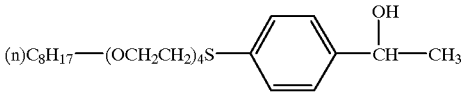

Practical examples of other nucleation accelerating compounds include, for example, exemplified Compounds (2–1) through (2–20) disclosed in JP O.P.I. NO. 6-258751, exemplified Compounds 3–1 to 3–6 disclosed in JP O.P.I. NO. 6-258751, onium compounds disclosed in JP O.P.I. NO. 7-270957, compounds represented by formula I disclosed in JP O.P.I. NO. 7-104420, and compounds disclosed from line 19 of lower right column of page 17 to line 4 of upper right column of page 18, and from lines 1 to 5 of lower right column of page 19 of JP O.P.I. NO. 2-103536 and thiosulfonic acid compound disclosed in JP O.P.I. NO. 1-27538.

These nucleation promoting compounds employed in the invention may be used in any photographic component layer provided on the side of the silver halide emulsion layer. Preferably, the compound is incorporated either in the silver halide emulsion layer or a layer located adjacent thereto. The adding amount thereof may be varied depending on the grain size of the silver halide particles, halide composition, degree of chemical ripening and kind of restraining agent, etc., however, it is generally from $10^{-6}$ to $10^{-1}$ mol, and, more preferably, from $10^{-5}$ to $10^{-2}$ mol per one mol of silver halide.

The quaternary onium salt compounds working as a hardening agent used in this invention is a compound having a quaternary cationic group of a nitrogen or phosphorus atom within the molecule, and a compound represented by the following formula (P). The quaternary onium salt described here displays function of nucleation accelerating agent when employed with the hydrazine compound in combination.

Formula (P)

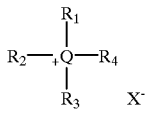

wherein Q is a nitrogen atom or a phosphorus atom; $R_1$, $R_2$, $R_3$ and $R_4$ each are a hydrogen atom or a substituent, X is an anion, provided that $R^1$, $R^2$, $R^3$ and $R^4$ combine together with each other to form a ring.

Examples of the substituent represented by $R_1$, $R_2$, $R_3$ and $R_4$ include an alkyl, alkenyl, alkynyl, aryl, heterocyclic, amino group etc., and practically an alkyl group (e.g., methyl, ethyl, propyl, butyl, hexyl, cyclohexyl), an alkenyl group (e.g., allyl, butenyl), an alkynyl group (e.g., propargyl, butynyl), an aryl group (e.g., phenyl, naphthyl), a heterocyclic group (e.g., piperidyl, piperazinyl, morpholinyl, pyridyl, furyl, thienyl, tetrahydrofuryl, tetrahydrothienyl, sulforanyl) etc are mentioned.

Examples of the ring formed by $R_1$, $R_2$, $R_3$ and $R_4$ include a piperidine ring, morpholine ring, piperazine ring, quinuclidine ring, pyridine ring and so on. The group represented by $R_1$, $R_2$, $R_3$ and $R_4$ may be further substituted by a hydroxy group, alkoxy group, aryloxy group, carboxy group, sulfo group, alkyl group or aryl group. Of these, $R_1$, $R_2$, $R_3$ and $R_4$ are each preferably a hydrogen atom or an alkyl group.

Examples of the anion of $X^-$ include a halide ion, sulfate ion, nitrate ion, acetate ion and p-toluenesulfonic acid ion.

Further pyridinium compounds represented by formulas (Pa), (Pb) and (Pc) are preferable.

formula (Pa)

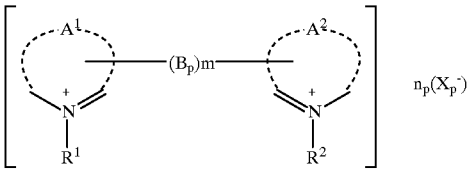

formula (Pb)

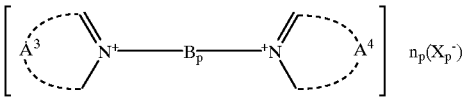

-continued formula (Pc)

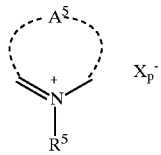

wherein $A^1$, $A^2$, $A^3$, $A^4$ and $A^5$ are each a nonmetallic atom group necessary to form a nitrogen containing heterocyclic ring, which may further contain an oxygen atom, nitrogen atom and a sulfur atom and which may condense with a benzene ring. The heterocyclic ring formed by $A^1$, $A^2$, $A^3$, $A^4$ or $A^5$ may be substituted by a substituent. Examples of the substituent include an alkyl group, an aryl group, an aralkyl group, alkenyl group, alkynyl group, a halogen atom, an acyl group, an alkoxycarbonyl group, an aryloxycarbonyl group, a sulfo group, a hydroxy group, an alkoxyl group, an aryloxy group, an amido group, a sulfamoyl group, a carbamoyl group, a ureido group, an amino group, a sulfonamido group, a sulfonyl group, a cyano group, a nitro group, a mercapto group, an alkylthio group, and an arylthio group. Exemplary preferred $A^1$, $A^2$, $A^3$, $A^4$ and $A^5$ include a 5- or 6-membered ring (e.g., pyridine, imidazole, thiazole, oxazole, pyrazine, pyrimidine) and more preferred is a pyridine ring.

Bp is a divalent linkage group, and m is 0 or 1. Examples of the divalent linkage group include an alkylene, arylene, alkenylene, —$SO_2$—, —SO—, —O—, —S—, —CO—, —N($R^6$)—, in which $R^6$ is an alkyl group, aryl group or a hydrogen atom. These groups may be included alone or in combination. of these, Bp is preferably an alkylene group or alkenylene group.

$R^1$, $R^2$ and $R^5$ are each an alkyl group having 1 to 20 carbon atoms, and $R^1$ and $R^2$ may be the same or different. The alkyl group may be substituted and substituent thereof are the same as defined in $A^1$, $A^2$ , $A^3$, $A^4$ and $A^5$. Preferred $R^1$, $R^2$ and $R^5$ are each an alkyl group having 4 to 10 carbon atoms, and more preferably an aryl-substituted alkyl group, which may be substituted.

$X_p^-$ is a counter ion necessary to counterbalance overall charge of the molecule, such as chloride ion, bromide ion, iodide ion, sulfate ion, nitrate ion and p-toluenesulfonate ion, oxalate ion and so on; $n_p$ is a counter ion necessary to counterbalance overall charge of the molecule and in the case of an intramolecular salt, $n_p$ is 0. Practical examples of the quaternary onium compounds are shown below.

P-1

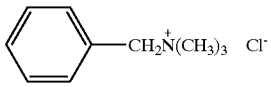

P-2

$C_{16}H_{33}\overset{+}{N}(CH_3)_3$ $Br^-$

P-3

$\overset{+}{N}(C_4H_9)_4$ $Cl^-$

P-4

$(CH_3)_3\overset{+}{N}CH_2CH_2OH$ $Cl^-$

P-5

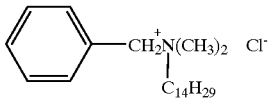

P-6

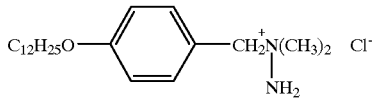

-continued
P-7
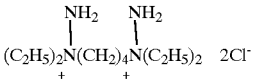
P-8
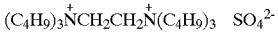
P-9
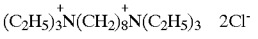
P-10
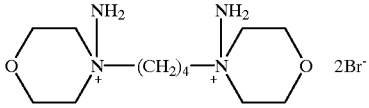
P-11
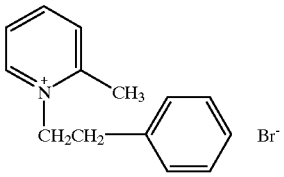
P-12
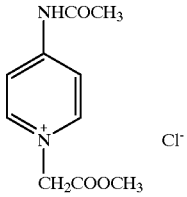
P-13
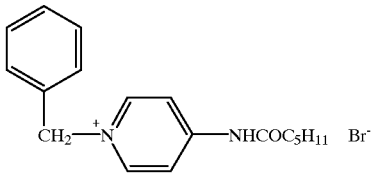
P-14
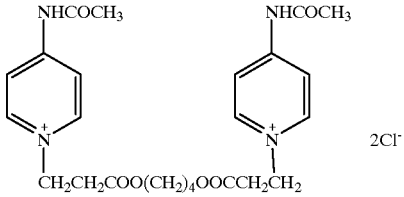
P-15
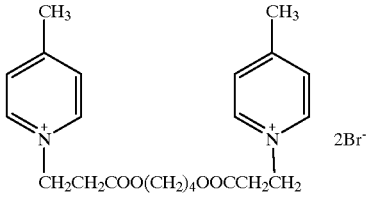
P-16
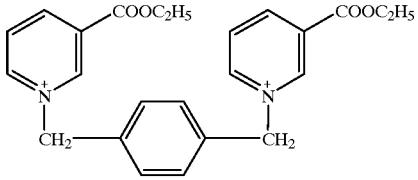
P-17
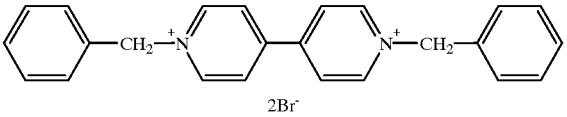
P-18
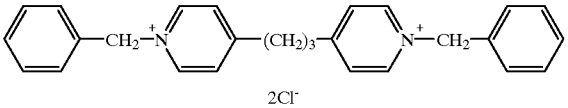
P-19
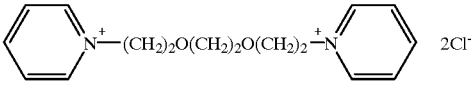
P-20
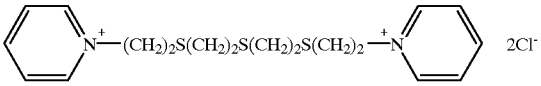
P-21
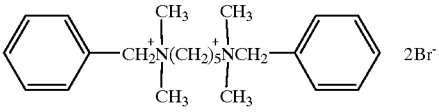
P-22
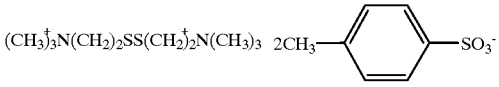
P-23
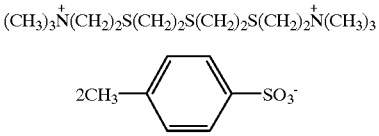
P-24
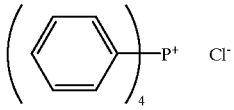
P-25
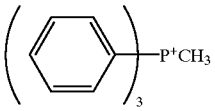
P-26
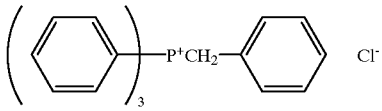

-continued
P-27
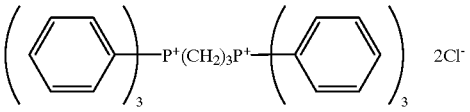
P-28
$(C_4H_9)_3\overset{+}{P}C_{16}H_{33}$ $Br^-$
P-29
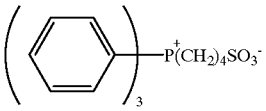
P-30
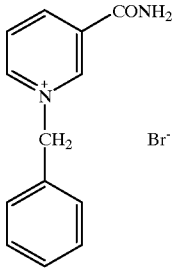
P-31
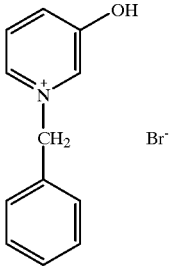
P-32
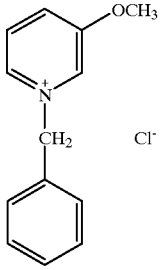
P-33
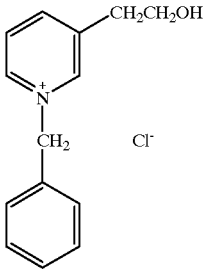
P-34
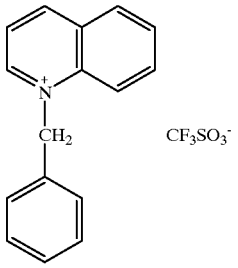
P-35
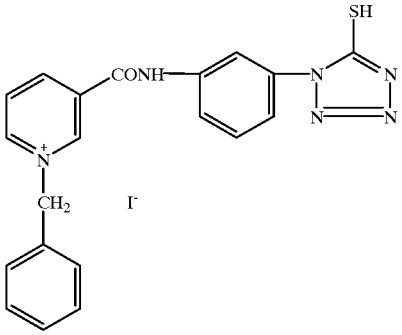
P-36
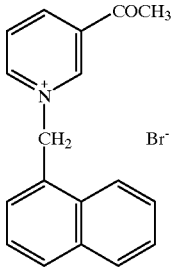

-continued
P-37
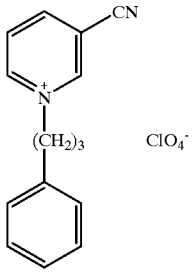
P-38
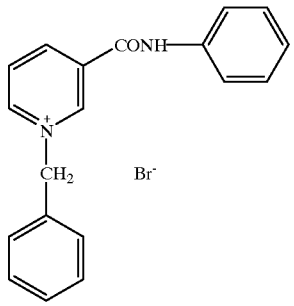
P-39
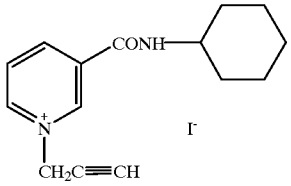
P-40
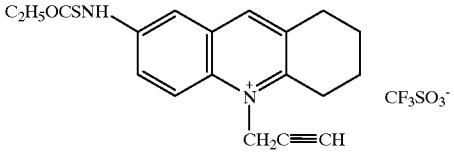
P-41
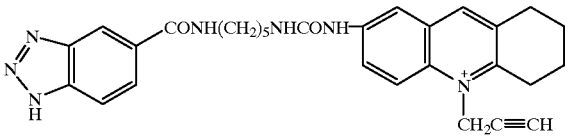
$CF_3SO_3^-$
P-42
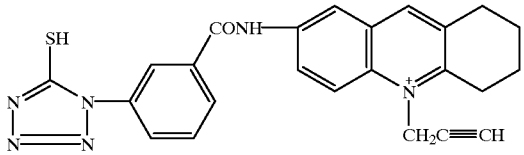
$ClO_4^-$
P-43
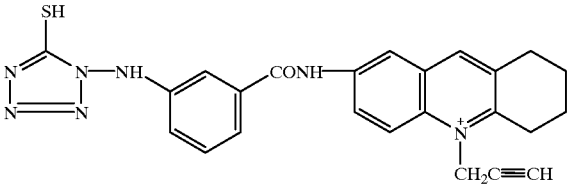
$ClO_4^-$
P-44
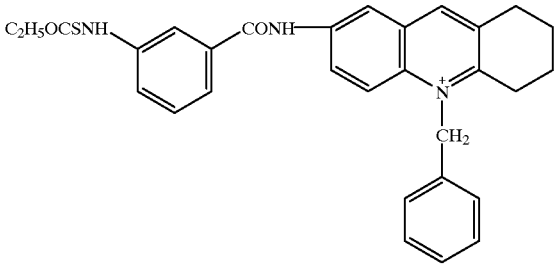
$CF_3SO_3^-$
P-45
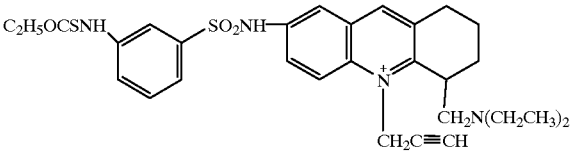
$CF_3SO_3^-$
P-46
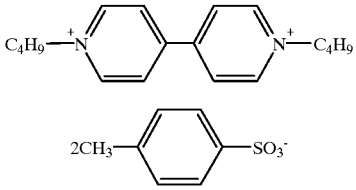
P-47
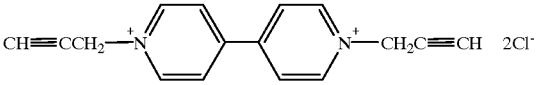
P-48
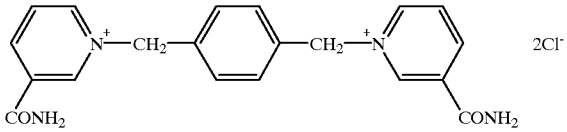
P-49
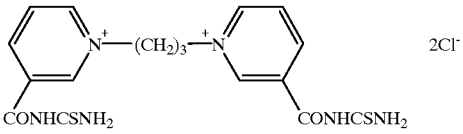
P-50
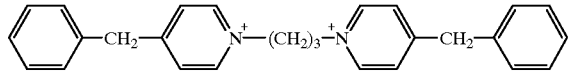

-continued

P-51

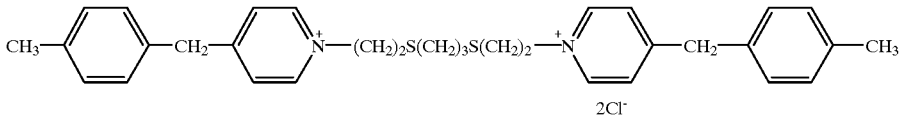

P-52

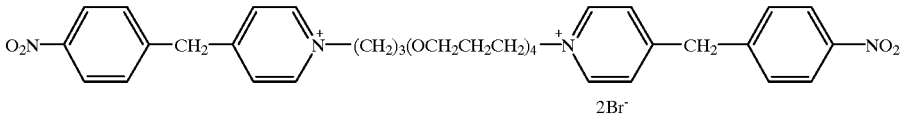

P-53

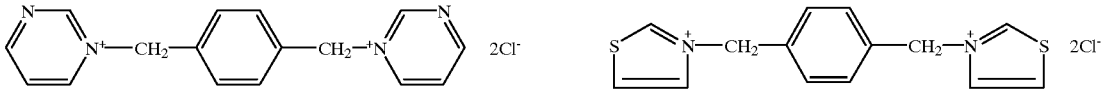

P-55

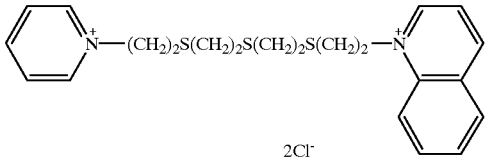

Tetrazolium compound represented by formula (T) is also preferably employed.

Formula (T)

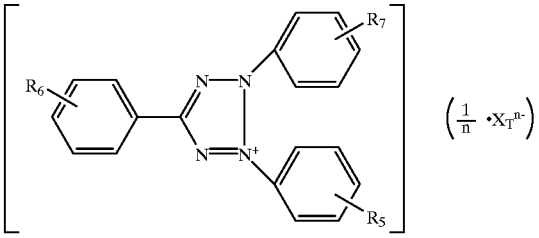

Substituents $R_7$, $R_8$, and $R_9$ on phenyl group of triphenyl tetrazolium represented by formula (T) is preferably a hydrogen atom or a group having negative sigma value (σP) which is an index of electron withdrawing property.

The Hammett's σ values in a phenyl group are found in many publications, for example, C. Hansch's report in Journal of Medical Chemistry, Volume 20, page 304, 1977 and the like. Groups having particularly preferred negative σ value include, for example, a methyl group (σP=−0.17, in the following, all the values are σP.), an ethyl group (−0.15), a cyclopropyl group (−0.21), a n-propyl group (−0.13), an iso-propyl group (−0.15), a cyclobutyl group (−0.15), a n-butyl group (−0.16), an iso-butyl group (−0.20), a n-pentyl group (−0.15), a cyclohexyl group (−0.22), an amino group (−0.66), an acetylamino group (−0.15), a hydroxyl group (−0.37), a methoxy group (−0.27), an ethoxy group (−0.24), a propoxy group (−0.25), a butoxy group (−0.32), a pentoxy group (−0.34), etc. and these are useful as the substituent of the compound represented by the general formula (T).

n represents 1 or 2. Anions represented by $X_T^{n-}$ include, for example, a halide ion such as a chloride ion, a bromide ion, an iodide ion, etc.; an acid radical of an inorganic acid such as nitric acid, sulfuric acid, perchloric acid; an acid group of an organic acid such as sulphonic acid, carboxylic acid, etc.; an anion series surface active agent, specifically, a lower alkylbenzenesulfonate anion such as p-toluenesulfonate anion, etc., a higher alkylbenzenesulfonate anion such as a p-dodecylbenzenesulfonate anion, a higher alkylsulfuric acid ester anion such as a laurylsulfate anion, etc.; a boric acid series anion such as teraphenyl boron, etc.; a dialkylsulfosuccinate anion such as di-2-ethylhexylsulfosuccinate anion, etc.; a higher fatty acid anion such as cetylpolyethenohexylsulfate anion, etc.; a polymer having an acid group such as polyacrylic acid anion; etc.

Practical examples of compounds represented by formula (T) are listed.

| Compound Number | $R_7$ | $R_8$ | $R_9$ | $X_T^{n-}$ |
|---|---|---|---|---|
| T-1 | H | H | p-$CH_3$ | $Cl^-$ |
| T-2 | p-$CH_3$ | H | p-$CH_3$ | $Cl^-$ |
| T-3 | p-$CH_3$ | p-$CH_3$ | p-$CH_3$ | $Cl^-$ |
| T-4 | H | p-$CH_3$ | p-$CH_3$ | $Cl^-$ |
| T-5 | p-$OCH_3$ | p-$CH_3$ | p-$CH_3$ | $Cl^-$ |
| T-6 | p-$OCH_3$ | H | p-$CH_3$ | $Cl^-$ |
| T-7 | p-$OCH_3$ | H | p-$OCH_3$ | $Cl^-$ |
| T-8 | m-$C_2H_5$ | H | m-$C_2H_5$ | $Cl^-$ |
| T-9 | p-$C_2H_5$ | p-$C_2H_5$ | p-$C_2H_5$ | $Cl^-$ |
| T-10 | p-$C_3H_7$ | H | p-$C_3H_7$ | $Cl^-$ |
| T-11 | p-$C_3H_7$ (i) | H | p-$C_3H_7$ (i) | $Cl^-$ |
| T-12 | p-$OC_2H_5$ | H | p-$OC_2H_5$ | $Cl^-$ |
| T-13 | p-$OCH_3$ | H | p-$C_3H_7$ (i) | $Cl^-$ |
| T-14 | H | H | p-$C_{12}H_{25}$ | $Cl^-$ |
| T-15 | p-$C_{12}H_{25}$ | H | p-$C_{12}H_{25}$ | $Cl^-$ |
| T-16 | H | p-$NH_2$ | H | $Cl^-$ |
| T-17 | p-$NH_2$ | H | H | $Cl^-$ |
| T-18 | p-$CH_3$ | H | p-$CH_3$ | $ClO_4^-$ |

The tetrazolium compounds described above can be readily synthesized according to the methods described in Chemical Review 55, page 335–483.

The compound represented by formula (T) may be employed singly or tow or more species in combination.

The quaternary onium compound employed in the invention such as ammonium compound, phosphonium compound, pyridinium compound and tetrazolium compound may be used in any photographic component layer provided on the side of the silver halide emulsion layer. Preferably, the compound is incorporated either in the silver halide emulsion layer or a layer located adjacent thereto. The adding amount thereof may be varied depending on the grain size of the silver halide particles, halide composition, degree of chemical ripening and kind of restraining agent, etc., however, it is generally from $10^{-6}$ to $10^{-1}$ mol, and, more preferably, from $10^{-5}$ to $10^{-2}$ mol per one mol of silver halide.

In the invention, developing replenisher or fixer replenisher prepared from a solid processing composition may be employed. The solid processing composition is a composition solidified in a form of powder, tablet, pill or granule, which is subjected to a moisture-proof treatment according to necessity. Ones in a form of paste or slurry are not included in the solid processing composition, which are semi-liquid state and inferior in the stability.

The "powder" means a mass of fine crystals. In the invention, the "granule" means grain-shaped matter having a grain size of 50 to 5000 μm which are prepared from powder by a granulation treatment. The "tablet" means a matter tableted in a certain shape by compressing power or granules. Among the above-mentioned solid processing composition, the tablet is preferably used since the tablet can be easily handled and the replenishing can be carried out with a high accuracy. Optional means such as a method by which a concentrated solution or powder of photographic processing composition is kneaded with a water-soluble binder and shaped or a method by which a water-soluble binder is sprayed on the surface of provisionally shaped photographic processing composition to form a covering layer thereon, can be applied for solidifying the processing composition, cf. JP O.P.I. Nos. 4-29136, 4-85535, 4-85536, 4-85533, 4-85534 and 4-172301.

A method by which powdered solid processing composition is granulated and tableted is preferred for preparing the tablet. Such prepared tablet is advantageous in that the solubility and storage ability is improved, as a result of that the photographic property of the processing composition is stabilized, compared with a tablet simply prepared by mixing and tableting the raw materials of solid processing composition.

In the granulation method for the tablet formation, a known method such as a tumbling granulation, extrusion granulation, compression granulation, crushing granulation, stirring granulation, fluidized bed granulation and spray-dry granulation may be applied. The granules having an average diameter of 100 to 800 μm, more preferably 200 to 750 μm, are preferably usable for forming the tablet by the reason of that the ununiformity of the composition so-called segregation is difficultly occurred. The distribution of the granule size in which the sizes of granules of not less than 60% of the whole granules are within the deviation of ±100 to 150 μm is preferable. A known compressing machine, for example, an oil compressing machine, single tableting machine, rotary tableting machine and briquetting machine are usable. Although the compressed and shaped solid processing composition may has an optional shape, a cylindrical form or a form of tablet is preferred from the viewpoint of the production efficiency, easy handling and protection of dust formation at the place of practical use. It is further preferable for enhancing the above-mentioned effects that an alkaline agent, reducing agent and preservant are separately granulated from each other.

The tableted processing composition may be prepared by the usual methods described in, for example, JP O.P.I. Nos. 51-61837, 54-155038 and 52-88025 and British Patent No. 1,213,808. The granulated processing composition may be prepared by the usual method described in, for example, JP O.P.I. Nos. 2-109042, 2-109043, 3-39735 and 3-39739. The powdered processing composition may be prepared by the usual methods described in, for example, JP O.P.I. No. 54-133332/1979, British Patent Nos. 725,892 and 729,862, and German Patent No. 3,733,861.

When the solid processing composition is in the form of tablet, the bulk density thereof is preferably 1.0 g/cm$^3$ to 2.5 g/cm$^3$ from the viewpoint of dissolving ability and the effects of the invention. The bulk density of not less than 1.0 g/cm$^3$ is preferable at the point of strength of solidified matter and that not more than 2.5 g/cm$^3$ is preferable at the point of dissolving ability. When the solid processing composition is in the form of powder or granule, ones having a bulk density of 0.40 to 0.95 g/cm$^3$ are preferable.

Solid processing agents are employed at least for developing agents and fixing agents, and in addition, may also be employed for the other photographic processing agents such as rinsing agents and the like. Further, it is possible that the developing agents as well as the fixing agents are exempted from the act for liquid dangerous substances. It is most preferable that all processing agents are comprised of solid processing agents. However, it is preferable that at least the developing agents and the fixing agents are solid agents.

Regarding solid processing agents, it is possible to only solidify one component of the processing agent. However, it is preferable that all components are solidified. It is further preferable that each component is molded as an individual solid processing agent and the molded solid processing agent is individually packaged. Further, it is preferable that other components are individually packaged in the sequential order of supply in which they are repeatedly used.

When a developer composition is solidified, it is preferable embodiment of the invention that an alkaline agent and reducing agent are all solidified in not more than three tablets, most preferably one tablet. When the composition is solidified in two or more composition, the plurality of tablet or granulated composition is preferably packed in the same package.

When fixing agents are solidified, all of fixing the agents, preservatives, and hardeners such aluminum salts are preferably solidified. When they are shaped into tablets, the number of tablets is at most three, and is preferably one or two tablets. Further when they are solidified while separating into at least two tablets, it is preferable that a plurality of tablets and granules are included in one package. Specifically, the aluminum salts are preferably solidified from the viewpoint of easier handling.

As the packaging material for the solid processing composition, a synthesized resin material such as polyethylene including one prepared by high-pressure method or one prepared by low-pressure method, an unstretched or stretched polypropylene, polyvinyl chloride, polyvinyl acetate, Nylon (stretched or unstretched), polyvinylidene chloride, polystyrene, polycarbonate, Vinylon, Eval, polyethylene terephthalate (PET), polyesters other PET, hydrochloric acid rubber, acrylonitrile/butadiene copolymer, epoxy-phosphoric acid type resin such as polymers described in JP O.P.I. Nos. 63-63037 and 57-32952, and pulp. Although two or more of the above-mentioned films are preferably laminated to use for packaging the solidified processing composition, a single film or a film on which another material is coated are usable. It is more preferably to provide various type of gas barrier layer such as an aluminum foil or an aluminum evaporated synthetic resin layer between the above-mentioned resin layers.

The oxygen permeability of the packaging material is preferably not more than $4.93\times10^{-4}$ ml/m$^2$·24hr-Pa, more preferably $2.96\times10^{-4}$ ml/m$^2$·24 hr·Pa, (at 20° C. and 65% RH) for raising the stability of the solid processing component and preventing stain formation.

The total thickness of the above laminated layers or the single layer is 1 to 3000 μm, more preferably 10 to 2000 μm, further preferably 50 to 1000 μm.

The above-mentioned synthetic resin film may be a single macromolecular resin layer or a laminated layer composed of two or more macromolecular resin layers.

When the processing composition is packaged or bound by a water-soluble film or a binder, a water soluble film or a binder composed of a material of polyvinyl alcohol type, methyl cellulose type, polyethylene oxide type, starch type, polyvinylpyrrolidone type, hydroxypropyl cellulose type, pullulan type, dextran type, gum arabic type, polyvinyl acetate type, hydroxyethyl cellulose type, carboxyethyl cellulose type, sodium salt of carboxymethylhydroxyethyl cellulose type, poly(alkyl)oxazoline type and polyethylene glycol type is preferably usable. Among them, polyvinyl alcohol type and pullulan type are particular preferred from the viewpoint of effects of covering and binding.

The thickness of the above-mentioned water-soluble film is preferably 10 to 120 μm, more preferably 15 to 80 μm, particularly preferably 20 to 60 μm from the view point of the storage stability of solid processing composition, dissolving time of the water-soluble film and the crystal precipitation in an automatic processor.

The tensile strength of the water-soluble film is preferably $5.20\times10^3$ to $5.20\times10^5$ Pa, more preferably $1.04\times10^4$ to $2.60\times10^6$ Pa, particularly $1.56\times10^4$ to $1.04\times10^5$ Pa. The strain strength is determined by the method described in JIS Z-1521.

The photographic processing composition covered or bound by the water-soluble film or binder is preferably packaged by a moisture-proof packaging material to protect from the damage caused by accidental contact to the moisture of the air such as high humidity, rain and fog, or to water spattered or adhered on hand in the course of storage, transportation and handling. A film having a thickness of 10 to 150 μm is preferred as the moisture-proof packaging material. The moisture-proof packaging material is preferably one selected from a film of polyolefin such as polyethylene terephthalate, polyethylene or polypropylene, a craft paper given a moisture-proof ability by polyethylene, wax paper, moisture-proof cellophane, glassine paper, polyester, polystyrene, polyvinyl chloride, polyvinylidene chloride, polyamide, polycarbonate or acrylonitrile, and a foil of metal such as aluminum and metallized polymer film. A complex material composed of the above-mentioned materials is also usable.

A degradable plastic, particularly a bio-degradable or photo-degradable plastic, is preferably usable.

The above-mentioned bio-degradable plastic includes one composed of a natural macromolecular substance, a polymer produced by a microorganism, a synthetic polymer having a high bio-decomposability. The photo-degradable plastic includes one having a group in the main chain which causes cleavage of the chain when the group is exited by UV. A plastic having both of the functions of photo-decomposition and bio-decomposition is preferably usable.

Concrete examples of the above-mentioned are described below.

Bio-Degradable Plastic (1) Natural macromolecular substance

Polysaccharides, cellulose, polylactic acid, chitin, chitosan, polyamino acid and decorative thereof (2) Polymer produced by microorganism Biopol composed of copolymer of 3-hydroxy-butyrate and 3-hydroxyvalerate (PHB–PHV) and cellulose produced by microorganism (3) Synthetic polymer having a high bio-decomposability Polyvinyl alcohol, polycaprolactone and a copolymer or mixture thereof (4) Combination of biodegradable natural macromolecular substance with plastic A natural macromolecular substance having a high bio-degradability such as starch and cellulose is combined with a plastic for giving a shape-collapsing ability.

Photo-Degradable Plastic (5) A plastic in which a carbonyl group is introduced for giving a photo-collapsing ability. A UV absorbent may be added for accelerating the collapse of the plastic.

As the above-mentioned degradable plastic, ones described in "Kagaku to Kogyo", vol. 64, No. 10, p.p. 478–484, 1990, "Kinou Zairyo", p.p. 23–34, July 1990, are usually usable. Degradable plastics available on the market such as Biopol (manufactured by ICI Co.), Eco (Manufactured by Union Carbide Co.), Ecolite (Manufactured by Eco Plastic Co.) and Ecostar (manufactured by St. Lawrence Starch Co.) are usable.

The moisture permeability of the above moisture-proof packaging material is preferably not more than 10 g·mm/m$^2$·24 hr, more preferably not more than 5 g·mm/m$^2$·24hr.

In the invention, it is preferable to employ a development aid such as 3-pyrazolidones such as 1-phenyl-3-pyrazolidone, 1-phenyl-4-methyl-3-pyrazolidone, 1-phenyl-4,4-dimetyl-3-pyrazolidone, 1-phenyl-4-ethyl-3-pyrazolidone and 1-phenyl-5-methyl-3-pyrazolidone, aminophenols such as o-aminophenol, p-aminophenol, N-methyl-o-aminophenol, N-methyl-p-aminophenol, 2,4-diaminophenol, in combination with the developing agent of ascorbic acid or its salt mentioned above. In this instance it is preferred to employ the development aid such as 3-pyrazolidones or aminophenols in amount of 0.5 moles to 2.5 moles more preferably 0.001 to 1.4 moles, per liter of the developing composition. Amount of ascorbic acid or its salt to be employed is about 0.05 to 1 mol per liter of the developing composition.

Hydroquinones which functions as the developing agent in the invention includes hydroquinone and its homologues such as chlorohydroquinone, bromohydroquinone, isopropylhydroquinone, methylhydroquinone, 2,3-dichlorohydroquinone, 2,5-dimethylhydroquinone, practically. The most generally hydroquinone is employed. These are employed in amount of about 0.08 moles to 0.3 moles preferably 0.1 to 0.25 moles, per liter of the developing composition. It is preferred to employ the development aid such as 3-pyrazolidones or aminophenols as well as in case of ascorbic acid or its salt.

Replenishing amount of the developer replenisher is preferably 250 ml/m$^2$ or less, more preferably 50 to 250 ml/m$^2$, and in particular 100 to 200 ml/m$^2$. By controlling the replenishing amount adequately, degradation of contrast at running processing is prevented while the waste effluent is reduced.

Amount of carbonate salt in the developer replenisher is preferably 0.5 mol/m$^2$ or more, and more preferably 0.5 to 1.2 0.5 mol/M$^2$, and in particular 0.5 to 0.9 mol/m$^2$. By controlling the amount of carbonate adequately, lowering of sensitivity and contrast caused by decomposition of developing agent can be prevented while preventing deposit of ingredient.

The silver halide light-sensitive photographic material is usually subjected to process in a washing bath or in a stabilizing bath after fixing process. The stabilizing solution usually contains, for the purpose of stabilizing an produced image, an inorganic or organic acid or salt thereof for adjusting pH of the membrane (at pH 3–8 after processing), or an alkaline agent or a salt thereof, including, for example, boric acid, metaboric acid, borax, phosphates, carbonates, potassium hydroxide, sodium hydroxide, ammonia water, mono-carboxylic acids, dicarboxylic acids polycarboxylic acids, citric acid, oxalic acid, malic acid acetic acid, etc.; aldehydes such as formalin, glyoxal, glutaralhehyde, etc.; chelating agents such as ethylenediaminetetraacetic acid, or an alkali metal salt thereof, nitrilotriacetic acid, polyphosphates, etc.; antimolds such as phenol, 4-chlorophenol, cresol, o-phenylphenol, chlorophenol, dichlorophenol, formaldehyde, p-hydroxybenzoate, 2-(4-thiazoline)-benzimidazole, benzisothiazolin-3-one, dodecyl-benzyl-methylammonium chloride, N-(fluorodichloromethylthio)-phthalimide, 2,4,4'-trichloro-2'-hydroxydiphenyl ether, etc.; toning agents and/or residual color-improving agents such as nitrogen-containing heterocyclic compounds, including, for example, 2-mercapto-5-sodiumsulfonate-benzimidazole, 1-phenyl-5-mercaptotetrazole, 2-mercaptobenzothiazole, 2-mercapto-5-propyl-1,3,4-triazole, 2-mercaptohypoxanthine, etc. Specifically, it is preferable that the stabilizing solution contains an antimold. These compounds may be replenished either in the form of a liquid or a solid.

The halide composition of the silver halide emulsion employed in the light-sensitive material according to the present invention is preferably composed of silver chloride of 60 mole percent or more. More preferably there are employed the silver halide emulsion comprising silver chlorobromide containing silver chloride of 60 mole percent or more, or silver chloroiodobromide containing silver chloride of 60 mole percent or more. The average grain diameter of silver halide is preferably not more than 0.5 $\mu$m and particularly preferably from 0.5 to 0.05 $\mu$m. The grain diameter described herein means the grain diameter of a spherical grain or a grain which can be approximated to a sphere. When a grain is cubic, the volume is converted to the sphere of which diameter is designated as the grain diameter. There is no limitation on the shape of the silver halide grain and there may be employed any of a tabular, spherical, cubic, tetradecahedral, regular octahedral shape and the like. The distribution of the grain size is preferably narrow and a so-called monodispersed emulsion is preferred in which 90% or preferably 95% of the total number of grains are included within grain size range of ±40% of the average grain size.

The silver halide emulsion comprises preferably at least one of metals selected from the VIII Group transition metals such as iridium, rhodium, ruthenium, osmium, etc., and rhenium, and these preferred are rhodium, ruthenium or osmium. Furthermore, in order to carry out an exposure employing a light source such as a laser beam, rhodium and rhenium are preferably employed. The amount of these transition metals to be added is preferably from $10^{-8}$ to $10^{-4}$ mole per mole of silver halide. Silver halide emulsion and its preparation method are described in Research Disclosure (RD) vol. 176, No. 17643, pages 22 to 23 (December 1978) or references cited therein.

The silver halide emulsion preferably undergoes chemical sensitization. The silver halide emulsion may be spectrally sensitized by a spectral sensitizer to a desired wavelength.

In order to prevent the formation of fog during production processes, storage and photographic processing, or stabilize photographic performances, various compounds known as an antifoggant and stabilizer may be added to the light-sensitive material. To a light-sensitive emulsion layer and a non-light-sensitive hydrophilic colloid layer, may be added inorganic or organic hardeners. To a light-sensitive emulsion layer and/or a non-light-sensitive hydrophilic colloid layer, various surface active agents may be added for various purposes such as coating aids, prevention of static charge formation, improvement in lubrication, emulsifying dispersion, prevention of adhesion, improvement in photographic characteristics, etc.

As a binder or protective colloid for photographic emulsion, gelatin is advantageously employed, and other hydrophilic colloids maybe employed.

The photographic emulsion may comprise a polymer which is composed of, as a monomer composition, alkyl (metha)acrylate, alkoxyacryl(metha)acrylate, glycidyl (metha)acrylate, (metha)acrylamide, vinylester such as vinylacetate, acrylonitrile, olefin, styrene, etc. as itself or combination thereof, or combination of these with acrylic acid, methacrylic acid, ?,?-unsaturated dicarboxylic acid, hydroxyalkyl(metha)acrylate, sulfoalkyl(metha)acrylate, styrenesulfonic acid etc., in order to improve dimensional stability and the like.

The light-sensitive material preferably comprises at least one of an electrically conductive layer on a support. As a representative method for preparing the electrically conductive layer, there are two methods, that is, one in which the layer is prepared employing a water-soluble electrically conductive polymer and a hydrophobic hardener, and the other in which the layer is prepared employing metal oxides. Regarding to these methods, a method described in JP O.P.I. No. 3-265842 may be employed.

Various conventional techniques and additives may be applied to the silver halide emulsion. These are described in above mentioned Research Disclosure (RD) vol. 176, No. 7643, (December 1978) and vol. 187, No. 8716, (November 1979).

Each of the emulsion layer or the protective layer may be composed of a single layer or multi-layer having two or more layers in the photosensitive material employed in the invention. An inter layer etc. may be provided between the layers in case of multi-layer composition.

Support which can be employed is cellulose acetate, cellulose nitrate, polyester such as polyethyleneterephthalate, polyolefin such as polyethylene, polystyrene, plastic containing styrene based polymer having syndioctatic structure (abbreviated as SPS hereafter), baryta paper, paper coated with polyolefin, glass metal etc. These support may be subjected to subbing process in accordance with demand.

EXAMPLES

Example 1

Preparation of Light-sensitive Material

Preparation of Silver Halide Emulsion A

An aqueous silver nitrate solution and an aqueous halide solution comprised of NaCl and KBr were added to solution A at a pH of 3, a temperature of 40° C., and a constant flow rate for 30 minutes, employing a double jet method, and 0.20 $\mu$m cubic crystals comprised of 70 mole percent of AgCl and 30 mole percent of AgBr were obtained. During said addition, the silver potential (EAg) was 160 mV at the start of mixing and decreased to 100 mV at the completion of mixing. Thereafter, unnecessary salts were removed employing ultrafiltration. Then, 15 g of gelatin per mole of silver were added, and the pH was adjusted to 5.7. Thereafter, the resultant mixture was dispersed at 55° C. for 30 minutes. After said dispersion, $4\times10^{-4}$ mole of Chloramin T per mole of silver was added. The silver potential of the finished emulsion was 190 mV (at 40° C.).

| | | |
|---|---|---|
| A: | Ossein gelatin | 25 g |
| | Nitric acid (5%) | 6.5 ml |
| | Deionized water | 700 ml |
| | $Na[RhCl_5(H_2O)]$ | 0.02 ml |
| B: | Silver nitrate | 170 g |
| | Nitric acid (5%) | 4.5 ml |
| | Deionized water | 200 ml |
| C: | NaCl | 47.5 g |
| | KBr | 51.3 g |
| | Ossein gelatin | 6 g |
| | $Na_3[IrCl_6]$ | 0.15 mg |
| | Deionized water | 200 ml |

Added to the obtained emulsion were, per mole of silver, $1.5\times10^{-3}$ mole of 4-hydroxy-methyl-1,3,3a,7-tatraazaindene and $8.5\times10^{-4}$ mole of potassium bromide, and then the pH and the EAg were adjusted to 5.6 and 123 mV, respectively. Then $2\times10^{-6}$ mole of flowers of sulfur in terms of the sulfur atoms and $1.5\times10^{-5}$ mole of chloroauric acid were added to the resultant mixture followed by chemical ripening at 50° C. for 80 minutes. Thereafter, added to the ripened emulsion were, per mole of silver, $2\times10^{-3}$ mole of 4-hydroxy-methyl-1,3,3a,7-tatraazaindene, $3\times10^{-4}$ mole of 1-phenyl-5-mercaptotetrazole, and $1.5\times10^{-3}$ mole of potassium iodide. After cooling the resultant mixture to 40° C., $4\times10^{-4}$ mole of sensitizing dye, S-1, per mole of silver was added.

Employing the emulsion prepared as described above, the first layer, the second layer, and the third layer described below, from the support side, were simultaneously applied onto one side of a subbed support so as to obtain the coated amount per $m^2$ as described in the formulas below, and subsequently cool-set. Thereafter, employing the dye formula described below, a backing layer was applied onto the sublayer having an antistatic layer on the opposite side, and subsequently cool-set at −1° C. Both sides were simultaneously dried to obtain a sample.

(Sublayer)

After applying corona discharge of 30 $W/m^2\cdot$minute to both surfaces of a biaxially stretched polyethylene terephthalate support (having a thickness of 100 $\mu$m), the sublayer having the composition described below was applied onto both sides of said support, and subsequently dried at 100° C. for one minute.

| | |
|---|---|
| 2-Hydroxyethyl methacrylate (25)-butyl acrylate (30)-t-butyl acrylate (25)-styrene (20) copolymer (figures show the weight ratio) | 0.5 $g/m^2$ |
| Surface active agent A | 3.6 $mg/m^2$ |
| Hexamethylene-1,6-bis(ethylene urea) | 10 $mg/m^2$ |

(Antistatic Layer)

After applying corona discharge of 10 $W/m^2\cdot$minute onto a subbed polyethylene terephthalate support, an antistatic layer having the composition described below was applied onto one side of said support at a speed of 70 m/minute, employing a roll-fit coating pan as well as an air knife, and subsequently dried at 90° C. for two minutes. The resultant coated layer was subjected to thermal treatment at 140° C. for 90 seconds.

| | |
|---|---|
| Water-soluble electrically conductive polymer B | 0.6 $g/m^2$ |
| Hydrophobic polymer particle C | 0.4 $g/m^2$ |
| Polyethylene oxide compound (having a Mw of 600) | 0.1 $g/m^2$ |
| Hardener E | 0.08 $g/m^2$ |
| (Emulsion Layer) | |
| First Layer: | |
| Gelatin | 0.30 $g/m^2$ |
| 1-Phenyl-4-methyl-4-hydroxymerhyl-3-pyrazolidone | 0.005 $g/m^2$ |
| Sodium isoamyl-n-decylsulfosuccinate | 0.005 $g/m^2$ |
| Sodium docecylbenezenesulfonate | 0.02 $g/m^2$ |
| 2-Methylhydroquinone | 0.10 $g/m^2$ |
| AM | 0.05 $g/m^2$ |
| Polystyrenesulfonic acid (having a Mw of 500,000) | 0.02 $g/m^2$ |
| Second Layer: | |
| Gelatin | 1.0 $g/m^2$ |
| Silver halide emulsion A with a silver amount of | 3.3 $g/m^2$ |
| Hydrazine compound H-34 | 0.015 $g/m^2$ |
| Hydrazine compound H-39 | 0.020 $g/m^2$ |
| Nucleation promoting agent Na-21 | 0.15 $g/m^2$ |
| 5-Nitroindazol | 0.01 $g/m^2$ |
| 2-Mercaptohypoxanthine | 0.02 $g/m^2$ |
| Polymer suspension comprised of 75 percent by weight of colloidal silica, 12.5 percent by weight of vinyl acetate, and 12.5 percent by weight of vinyl pivalinate | 1.4 $g/m^2$ |
| Polymer latex L1 (having a particle diameter of 0.10 $\mu$m) | 0.5 $g/m^2$ |
| Dextran (having an average molecular weight of 40,000) | 0.1 $g/m^2$ |
| Surface active agent | 0.09 $g/m^2$ |
| 4-Mercapto-3,5,6-fluorophthalic acid | 0.05 $g/m^2$ |
| Sodium polystyrenesulfonate (having an average molecular weight of 500,000) | 0.015 $g/m^2$ |
| The pH of the coating composition was 5.2. | |
| Third Layer: | |
| Gelatin | 0.50 $g/m^2$ |
| Dextran (having an average molecular weight of 40,000) | 0.2 $g/m^2$ |
| Colloidal silica | 0.10 $g/m^2$ |
| Surface active agent SU-2 | 0.02 $g/m^2$ |
| Sodium dihexylsulfosuccinate | 0.010 $g/m^2$ |
| Disinfectant Z | 0.005 $g/m^2$ |
| Hardener (1) | 0.07 $g/m^2$ |
| Polymethyl methacrylate latex (having a size of 3 $\mu$m) | 0.01 $g/m^2$ |
| (Backing Layer) | |
| Gelatin | 2.0 $g/m^2$ |
| F-2 | 0.035 $g/m^2$ |
| F-3 | 0.1 $g/m^2$ |
| Sodium dihexylsulfosuccinate | 0.020 $g/m^2$ |
| Polymer suspension comprised of 75 percent by weight of colloidal silica, 12.5 percent by weight of vinyl acetate, and 12.5 percent by weight of vinyl pivalinate | 0.7 $g/m^2$ |
| Sodium polystyrenesulfonate | 0.010 $g/m^2$ |
| Matting agent (monodispersed polymethyl methacrylate having an average particle diameter of 3 $\mu$m) | 0.045 $g/m^2$ |
| Hardener (1) | 0.05 $g/m^2$ |
| Hardener (2) | 0.07 $g/m^2$ |

S-1

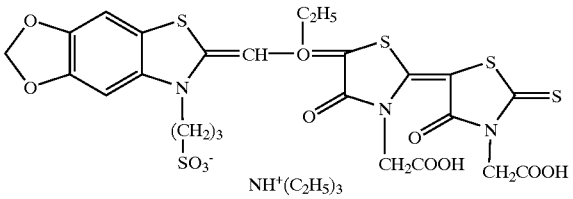

L1

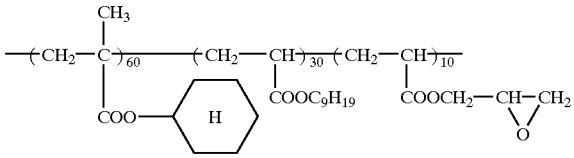

SU-1

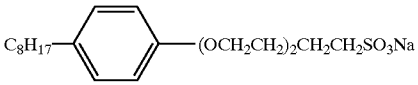

SU-2

$C_7F_{15}CH_2(OCH_2CH_2)_{13}OH$

AM

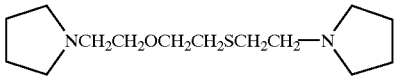

Hardener (1)

$(CH_2{=}CHSO_2CH_2CONHCH_2)_2{-}$

Hardener (2)

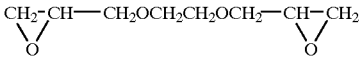

Disinfectant Z

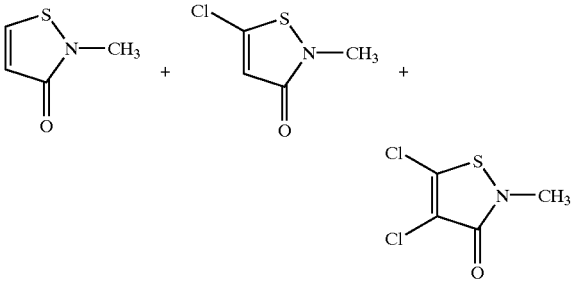

Water-soluble electrically conductive polymer B

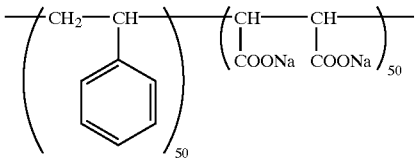

Hydrophobic polymer particle C

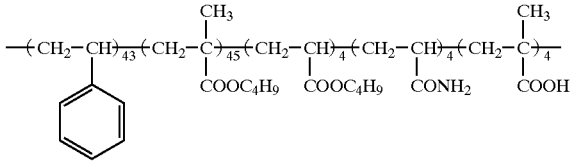

-continued

Hardener E

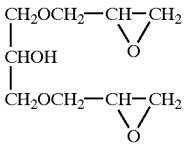

Surface Active Agent A

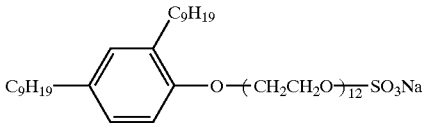

F-2

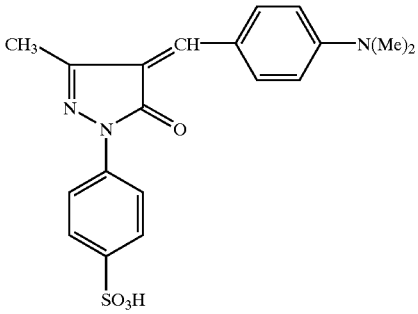

F-3

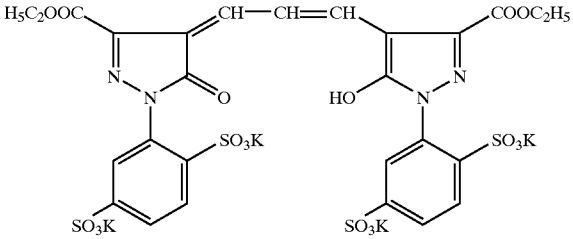

(Preparation of Developer)

(Preparation of Solid Developer 103 (equivalent to 10 liters))

1) Preparation of Developing Agent Granule DA

Pretreatment of Components

Hydroquinone was pulverized at a mesh of 8 mm and a rotation frequency of 25 Hz, employing a MIKURO-PULVERIZER AP-B, manufactured by Hosokawa Micron CORP. KBr was sized to a mesh of 0.25 mm, employing a commercially available sizing machine.

Blending of Components

The components described below were blended for 15 minutes employing a commercially available V-type blender (having a capacity of 200 liters).

| | |
|---|---|
| Hydroquinone (said pulverized one) | 42.57 kg |
| Sodium erithorbinate (manufactured by Feizer) | 10.64 kg |
| Dimezone-S (a kind of pyrazolidone) | 2.31 kg |
| Compound (1)-1 of the present invention | 0.05 kg |
| DTPA.5H | 7.09 kg |
| KBr (sized as described above) | 3.55 kg |
| Benzotriazole | 0.51 kg |
| Sorbitol | 3.14 kg |

From randomly selected points (5 locations) of the obtained mixture, 50 g from each location was individually sampled and analyzed. As a result, it was found that the concentration of each component was within ±1 percent of said formula value and blending was considered to have been carried out sufficiently and uniformly.

Molding

Said mixture was molded under conditions of a pocket shape of 5.0 Φm×1.2 mm (in depth), a rotation frequency of the roller of 15 rpm, and a rotation frequency of the feeder of 24 rpm, employing a compression granulator Briquetter BSS-IV Type, manufactured by Shinto Kogyo Co., Ltd. The obtained plate shaped mold was granulated employing a sizer to classify 2.4 to 7.0 mm granules and 2.4 mm or less fine granules (while 7.00 mm or more granules were regranulated). The 2.4 mm or less granules were blended into said mixture and the resultant mixture was returned to a compression molding machine and remolded. According to the method described above, about 68 kg of developing agent granule DA were obtained.

2) Preparation of Alkali Granule DB

Preparation of Components

Dissolved in 400 ml of ethyl alcohol were 556 g of 1-phenyl-5-mercaptotetrazole. A small amount of the resultant solution was dripped into 20 kg of anhydrous sodium carbonate which was rotated employing a mixer, and the rotation was continued until the mixture was sufficiently dried. From randomly selected points (5 locations) of the obtained mixture, 10 g from each location was individually sampled and subsequently analyzed. Then it was considered that 1-phenyl-5-mercaptotetrazole was sufficiently and uniformly mixed. The obtained mixture was designated as M-1.

Blending of Potassium Carbonate/M-1/Sodium Octanesulfonate

The components described below were blended for 10 minutes employing a commercially available V type blender (having a capacity of 200 liters).

| | |
|---|---|
| Potassium carbonate | 14.85 kg |
| M-1 | 11.44 kg |
| anhydrous sodium sulfite | 35.85 kg |
| D-mannitol | 4.63 kg |
| D-sorbitol | 1.86 kg |

After blending, 1.37 kg of sodium 1-octanesulfonate were added and blended for further 5 minutes.

Molding

Said mixture was molded under conditions of a pocket shape of 5.0 Φmm×1.2 mm (in depth), a rotation frequency of the roller of 15 rpm, and a rotation frequency of the feeder of 44 rpm, employing a compression granulator Briquetter BSS-IV Type, manufactured by Shinto Kogyo Co., Ltd. The obtained plate shaped mold was granulated employing a sizer to classify 2.4 to 7.0 mm granules and 2.4 mm or less fine granules (while 7.00 mm or more granules were granulated). The 2.4 mm or less granules were blended into said mixture and the resultant mixture was returned to a compression molding machine and remolded. According to the method described above, about 68 kg of alkali granule DB were obtained.

Packaging (10-liter kit of working solution)

A 10-liter capped polyethylene bottle was filled with molded granules and $LiOH{\cdot}H_2O$ in the order described below. In order to minimize degradation due to aerial oxidation, 10 liters of nitrogen gas was introduced into the bottle and was sealed with the cap to obtain packaged solid developer 11. Incidentally, as shown in Table 1, solid developer 12 comprises no compound of the present invention, and solid developers 13 and 14 comprise (1)-3 and (1)-5 of the present invention, respectively.

| | |
|---|---|
| $LiOH.H_2O$ | 750.0 g |
| DB | 1174.9 g |
| DA | 355.2 g |

(Preparation of Working Developing Solution (common to the starting solution and the replenisher))

Said solid developer 11 was placed into 9 liters of tap water which was stirred with a commercially available stirrer, for about 40 minutes to obtain 10 liters of the replenisher (the same as the starting solution). The pH of the resultant replenisher was 10.55.

(Preparation of Fixer)

(Preparation of Solid Fixer (10 liters))

1) Preparation of Fixing Agent Granule FA

Pre-treatment of Components

Sodium 1-octanesulfonate was pulverized to a 4 mm mesh at a rotation frequency of 60 Hz, employing a Mikro-Pulverizer AP-B, manufactured by Hosokawa MICRON CORP. Ammonium thiosulfate (10 percent sodium salt, manufactured by Tetenal Co.) was classified at a 1 mm mesh into a mesh employing a commercially available sizer. In the same manner, anhydrous sodium acetate was classified at 0.5 mm mesh. The resultant particle size distribution of ammonium thiosulfate had a peak between 710 and 850 μm, while that of sodium acetate had a peak at 500 μm.

Blending of Components

The components described below were blended for 10 minutes, employing a commercially available V-type blender (having a capacity of 200 liters).

| | |
|---|---|
| Ammonium thiosulfate (10% sodium salt) | 49.68 kg |
| Sodium sulfite | 3.37 kg |
| Sodium metabisulfite | 5.31 kg |
| Anhydrous sodium acetate | 10.60 kg |

Added to the resultant mixture was 1 kg of sodium 1-octanesulfonate (said pulverized component) and the resultant mixture was blended for further 5 minutes.

Molding

Said mixture was molded under conditions of a pocket shape of 5.0 Φmm×1.2 mm (in depth), a rotation frequency of the roller of 25 rpm, and a rotation frequency of the feeder of 36 rpm, employing a compression granulator Briquetter BSS-IV Type, manufactured by Shinto Kogyo Co., Ltd. The obtained plate shaped mold was granulated employing a sizer to classify 2.4 to 7.0 mm granules and 2.4 mm or less granules (while 7.00 mm or more granules were granulated). The 2.4 mm or less granules were blended with said mixture and the resultant mixture was returned to a compression molding machine and remolded. According to the method described above, about 69 kg of fixing agent granule FA was obtained.

(2) Preparation of Hardener Granule FB

Blending of Components

The components described below were blended for 10 minutes employing a commercially available V-type blender (having a capacity of 200 liters).

| | |
|---|---|
| Dehydrated aluminum sulfate (trade name, manufactured by Daimei Kagaku Co.) | 41.42 kg |
| Boric acid or crystallization retarder | amount shown in Table 1 |
| D-mannitol | 3.17 kg |
| D-sorbitol | 3.17 kg |

Added to the resultant mixture was 630 g of sodium 1-octanesulfonate (said pulverized component) and the resultant mixture was blended for 5 minutes more.

Molding

Said mixture was molded employing a compression granulator, Briquetter BSS-IV Type, manufactured by Shinto Kogyo Co., Ltd., while adjusting the pocket shape to 5.0 Φmm×1.2 mm (in depth), the rotation frequency of the roller to 25 rpm, and the rotation frequency of the feeder to obtain a voltage applied to the roll of 16 to 19 amperes. The obtained plate shaped mold was granulated employing a sizer to classify 2.4 to 7.0 mm granules and 2.4 mm or less granules (while 7.00 mm or more granules were modulated). The 2.4 mm or less granules were blended with said mixture and the resultant mixture was returned to a compression molding machine and remolded. According to the method described above, about 69 kg of fixing agent granule FB was obtained.

(3) Preparation of Solid Acid Granule FC

Blending of Components

The components described below were blended for 10 minutes employing a commercially available V-type mixer (having a capacity of 200 liters).

| | |
|---|---|
| Tartaric acid | 12.96 kg |
| Succinic acid | 57.04 kg |

Molding

Said mixture was molded under conditions of a pocket shape of 5.0 Φmm×1.2 mm (in depth), a rotation frequency of the roller of 25 rpm, and a rotation frequency of the feeder of 36 rpm, employing a compression granulator Briquetter BSS-IV Type, manufactured by Shinto Kogyo Co., Ltd. The obtained plate shaped mold was granulated employing a sizer to classify 2.4 to 7.0 mm granules and 2.4 mm or less granules (while 7.00 mm or more granules were granulated). The 2.4 mm or less granules were blended with said mixture and the resultant mixture was returned to a compression molding machine and remolded. According to the method described above, about 69 kg of solid acid granule FC was obtained.

Packaging (10-liter kit of working solution)

A 10-liter capped polyethylene bottle was filled with molded granules in the order described below. After introducing 3.0 liters of nitrogen gas into the bottle, the bottle was sealed with the cap.

| | |
|---|---|
| FA | 1848.9 g |
| FB | 162.0 g |
| FC | amount shown in Table 1 |

(Preparation of Working Replenisher)

Said solid fixing agent was placed into 8.5 liters of tap water which was stirred with a commercially available stirrer for about 40 minutes to obtain 10 liters of working replenisher FR. The pH was adjusted to 4.70, employing 50% aqueous sulfuric acid and NaOH.

(Processing and Evaluation)

Each of the samples of light-sensitive materials, which had been obtained, was exposed employing FTR-3050, manufactured by Dainippon Screen Co., Ltd., and was processed employing an automatic processor LD-T 1060, manufactured by Dainippon Screen Co., Ltd. The processing conditions are described below. The combinations of light-sensitive materials with types of developers are shown in Table 1.

(Processing Conditions)

| | | | |
|---|---|---|---|
| Development | 35° C. | 30 sec | replenishment rate of developer: 120 ml/m$^2$ |
| Fixing | 32° C. | 30 sec | replenishment rate of fixer: 200 ml/m$^2$ |
| Water Washing | normal temperature | 30 sec | washing water rate: 2 L/min |
| Drying | 45° C. | 30 sec | |

For 10 days, continuously processed per day were 200 610×508 mm sheets, in which 10 percent of the total area of each sheet was exposed. After processing, the processing unevenness (screen tint unevenness) as well as the staining of the water washing tank was evaluated.

(Evaluation of Processing Unevenness)

Employing FTR-3050, manufactured by Dainippon Screen Co., Ltd., an 80 percent screen tint having 175 lines was outputted onto each sample, and the resultant sample was subjected to photographic processing employing said exhausted processing solutions after said running processing. The processing unevenness of each processed film was visually evaluated. The processing unevenness was subjected to sensory evaluation, employing a 5-point method, in which good processing unevenness was 5, while poor processing unevenness was 1. The commercially viable processing unevenness was considered to be 3 or higher.

Evaluation of Staining of Water Washing Tank

An automatic processing machine was operated continuously for three days, and deposits in the water washing tank as well as the sliminess of rollers was evaluated based on the criteria described below.

(Evaluation of Deposit in Water Washing Tank of Automatic Processor)

Rank 1: a large amount of deposit was deposited on the bottom of the automatic processor, and the washing water became a turbid yellowish white Rank 2: a small amount of deposit was deposited on the bottom of the automatic processor, and the washing water became a turbid white Rank 3: some deposit was deposited on the bottom of the automatic processor, and the washing water become slightly turbid Rank 4: a very small amount of deposit was observed by manually touching the bottom of the automatic processor and the washing water was transparent Rank 5: no deposit was detectable at the bottom of the automatic processor and the washing water was transparent.

(Evaluation of Roller Stain)

Rank 1: the rollers were slimy, and a large amount of stain was carried over to the squeezing rollers Rank 2: the rollers were slimy, and the squeezing rollers were somewhat stained Rank 3: the rollers were partially slimy, but the squeezing rollers were not stained Rank 4: the edges of the rollers were somewhat slimy
Rank 5: the rollers were not at all slimy.

For both items, Rank 3 or better was considered to be commercially viable. Based on said criteria, evaluation was carried out including any intermediate between the five ranks.

TABLE 1

| Experiment No. | Light-sensitive Material | Solid Developer No. | Solid Developer Compound of the Invention | Solid Fixer Boric Acid (kg) | Solid Fixer Crystallization Retarder | Solid Fixer FB Filled Amount (g) | Processing Unevenness | Water Washing Tank Deposit | Roller Stain | Remarks |
|---|---|---|---|---|---|---|---|---|---|---|
| 101 | Example 1 | 11 | (1)-1 | 21.61 | — | 192.6 | 3 | 2 | 2 | Comp. |
| 102 | Example 1 | 11 | (1)-1 | 21.61 | Na gluconate | 212.6 | 3 | 2 | 2 | Comp. |
| 103 | Example 1 | 11 | (1)-1 | 10.81 | Na gluconate | 182.6 | 3 | 2 | 2 | Comp. |
| 104 | Example 1 | 11 | (1)-1 | — | Na gluconate | 142.6 | 4 | 5 | 5 | Inv. |
| 105 | Example 1 | 11 | (1)-1 | — | Na gluconate | 152.6 | 5 | 5 | 5 | Inv. |
| 106 | Example 1 | 12 | — | — | Na gluconate | 152.6 | 2 | 4 | 4 | Comp. |
| 107 | Example 1 | 11 | (1)-1 | — | Na glycolate | 152.6 | 5 | 5 | 5 | Inv. |
| 108 | Example 1 | 13 | (1)-3 | 21.61 | — | 192.6 | 3 | 2 | 2 | Comp. |
| 109 | Example 1 | 13 | (1)-3 | 21.61 | Na gluconate | 212.6 | 3 | 2 | 2 | Comp. |
| 110 | Example 1 | 13 | (1)-3 | 10.81 | Na gluconate | 182.6 | 3 | 2 | 2 | Comp. |
| 111 | Example 1 | 13 | (1)-3 | — | Na gluconate | 142.6 | 4 | 5 | 5 | Inv. |
| 112 | Example 1 | 13 | (1)-3 | — | Na gluconate | 152.6 | 5 | 5 | 5 | Inv. |
| 113 | Example 1 | 12 | — | — | Na gluconate | 152.6 | 2 | 4 | 3 | Comp. |
| 114 | Example 1 | 13 | (1)-3 | — | Na glycolate | 152.6 | 5 | 5 | 5 | Inv. |
| 115 | Example 1 | 14 | (1)-5 | — | Na gluconate | 152.6 | 5 | 5 | 5 | Inv. |

Comp.: comparative,
Inv.: present invention

As can be seen from the results of Table 1, the processing method of the present invention markedly minimizes the processing unevenness as well as the staining of the water washing tank.

Example 2

Evaluation was carried out in the same manner as Example 1, except that the developer was varied to one (in which ascorbic acid was employed as the developing agent) described below, and further, the processing conditions were varied.

(Preparation of Developer)

(Preparation of Solid Developer 21 (for 10-liter use))

1) Preparation of Developing Agent Granule DA

Pretreatment of Components

Benzotriazole was pulverized at a mesh of 8 mm and a rotation frequency of 25 Hz, employing a MIKURO-PULVERIZER AP-B, manufactured by Hosokawa Micron CORP. KBr was sized to a mesh of 0.25 mm, employing a commercially available sizing machine.

Blending of Components

The components described below were blended for 15 minutes, employing a commercially available V-type blender (having a capacity of 200 liters).

| | |
|---|---|
| L-sodium ascorbate | 69.38 kg |
| Dimezone-S | 2.02 kg |
| Compound (1)-1 of the present invention | 0.03 kg |
| DTPA.5H | 4.63 kg |
| KBr (said sized one) | 5.78 kg |
| Benzotriazole (said sized one) | 0.52 kg |

Blended with said mixture were 2.31 kg of 1-octanesulfonate which had been pulverized at a mesh of 4 mm and a rotation frequency of 60 Hz, employing a MIKURO-PULVERIZER AP-B, manufactured by Hosokawa Micron CORP., and the resultant mixture was further blended for 5 minutes.

From randomly selected points (5 locations) of the obtained mixture, 50 g from each location was individually sampled and analyzed. As a result, it was found that the concentration of each component was within ±1 percent of said formula value and blending was considered to be carried out sufficiently and uniformly.

Molding

Said mixture was molded under conditions of a pocket shape of 5.0 Φmm×1.2 mm (in depth), a rotation frequency of the roller of 15 rpm, and a rotation frequency of the feeder of 44 rpm, employing a compression granulator Briquetter BSS-IV Type, manufactured by Shinto Kogyo Co., Ltd. The obtained plate shaped mold was granulated employing a sizing machine to classify 2.4 to 7.0 mm granules and 2.4 mm or less fine granules (while 7.00 mm or more granules were granulated). The 2.4 mm or less granules were blended into said mixture and the resultant mixture was returned to a compression molding machine and remolded. According to the method described above, about 100 kg of developing agent granule DA were obtained.

Packaging (10-liter kit of working solution)

A 10-liter polyethylene bottle type container with a cap was filled with molded granules and carbonates in the order described below. In order to minimize degradation due to aerial oxidation, 10 liters of nitrogen gas was introduced into the container which was then sealed with the cap to obtain a packaged solid developer 21.

Further, as shown in Table 2, solid developer 22 comprises no compound of the present invention, while, solid developers 23 and 24 comprise (1)-3 and (1)-5 of the present invention, respectively.

| | |
|---|---|
| Potassium carbonate | 241.9 g |
| Sodium carbonate | 556.4 g |
| DA | 884.8 g |

Said solid developer 21 was placed into 9 liters of tap water which was stirred employing a commercially available stirrer to obtain 10 liters of the replenisher (which was also used as the starting solution). The pH of the obtained working replenisher was 10.20.

(Preparation of Fixer)

A solid fixer, as well as its working replenisher, was prepared in the same manner as Example 1.

(Processing and Evaluation)

The evaluation was carried out in the same manner as Example 1, except that the processing conditions were varied. Combinations of the light-sensitive material, solid developers, and solid fixers are shown in Table 2.

(Processing Conditions)

| | | | |
|---|---|---|---|
| Development | 38° C. | 15 sec | replenishment rate of developer: 120 ml/m$^2$ |
| Fixing | 32° C. | 15 sec | replenishment rate of fixer: 200 ml/m$^2$ |
| Water Washing | normal temperature | 15 sec | washing water rate: 2 L/min |
| Drying | 45° C. | 15 sec | |

Table 2 shows the results. In the same manner as Example 1, the processing method of the present invention results in minimization of processing unevenness as well as reduced staining of the water washing tank.

TABLE 2

| | | Solid Developer | | Solid Fixer | | | Process- | Water | | |
|---|---|---|---|---|---|---|---|---|---|---|
| Experiment No. | Light-sensitive Material | No. | Compound of the Invention | Boric Acid (kg) | Crystallization Retarder | FB Filled Amount (g) | ing Unevenness | Washing Tank Deposit | Roller Stain | Remarks |
| 201 | Example 1 | 21 | (1)-1 | 21.61 | — | 192.6 | 1 | 2 | 2 | Comp. |
| 202 | Example 1 | 21 | (1)-1 | 21.61 | Na gluconate | 212.6 | 1 | 2 | 2 | Comp. |
| 203 | Example 1 | 21 | (1)-1 | 10.81 | Na gluconate | 182.6 | 2 | 2 | 2 | Comp. |
| 204 | Example 1 | 21 | (1)-1 | — | Na gluconate | 142.6 | 4 | 5 | 5 | Inv. |
| 205 | Example 1 | 21 | (1)-1 | — | Na gluconate | 152.6 | 4 | 5 | 5 | Inv. |
| 206 | Example 1 | 22 | — | — | Na gluconate | 152.6 | 2 | 4 | 4 | Comp. |
| 207 | Example 1 | 21 | (1)-1 | — | Na glycolate | 152.6 | 4 | 5 | 5 | Inv. |
| 208 | Example 1 | 23 | (1)-3 | 21.61 | — | 192.6 | 3 | 2 | 2 | Comp. |
| 209 | Example 1 | 23 | (1)-3 | 21.61 | Na gluconate | 212.6 | 3 | 2 | 2 | Comp. |
| 210 | Example 1 | 23 | (1)-3 | 10.81 | Na gluconate | 182.6 | 3 | 2 | 2 | Comp. |
| 211 | Example 1 | 23 | (1)-3 | — | Na gluconate | 142.6 | 4 | 5 | 5 | Inv. |
| 212 | Example 1 | 23 | (1)-3 | — | Na gluconate | 152.6 | 4 | 5 | 5 | Inv. |
| 213 | Example 1 | 22 | — | — | Na gluconate | 152.6 | 2 | 4 | 3 | Comp. |
| 214 | Example 1 | 23 | (1)-3 | — | Na glycolate | 152.6 | 4 | 5 | 5 | Inv. |
| 215 | Example 1 | 24 | (1)-5 | — | Na gluconate | 152.6 | 4 | 5 | 5 | Inv. |

Comp.: comparative,
Inv.: present invention

Example 3

(Preparation of Support)

(Synthesis of SPS)

Added to 200 g of toluene were 100 g of styrene, 56 g of triisobutyl aluminum, and 234 g of pentamethylcyclopentadienyl titanium trimethoxide, and the resultant mixture underwent reaction at 96° C. for 8 hours. After removing the catalyst, upon its decomposition, employing a methanol solution of sodium hydroxide, washing was carried out three times employing methanol to obtain 34 g of the target compound.

(Preparation of SPS Film)

The obtained SPS was melt-extruded into a film employing a T die, and then solidified upon rapidly cooling the resultant film on a cooling drum to obtain an unstretched film. At that time, cooling drum receiving speeds were carried out at two stages. The resultant 1370 μm, 1265 μm and 1054 μm thick unstretched films were preheated at 135° C.; longitudinally stretched (by a factor of 3.1); and then laterally stretched (by a factor of 3.4) at 130° C.; and further thermally fixed at 250° C. As a result, 130 μm and 100 μm thick biaxially stretched films, having a bending elastic modulus of $4.41\times10^9$ Pa, were obtained.

(Subcoating of SPS Film)

An adhesive layer comprised of styrene-glycidyl acrylate was formed on said SPS film, and an antistatic layer comprised of a polymer, containing tin oxide sol, was formed on said adhesive layer.

(Preparation of Silver halide Emulsion A)

Employing a double-jet method, prepared were silver chlorobromide core grains comprised of 70 mole percent of silver chloride and 30 mole percent of silver bromide, which had an average thickness of 0.05 μm and an average diameter of 0.15 μm. During mixing said core grains, $8\times10^{-8}$ mole of $K_3RuCl_6$ per mole of silver was added. Said core grains were covered with shells, employing a double-jet method. At that time, $3\times10^{-7}$ mole of $K_2IrCl_6$ per mole of silver was added.

The obtained emulsion was a core/shell type monodispersed tabular grain silver chlorobromoiodide (comprised of 90 mole percent of silver chloride, 0.2 mole percent of silver iodide, and 9.8 mole percent of silver bromide) emulsion, at an average thickness of 0.10 μm and an average diameter of 0.25 μm (having a variation coefficient of 10 percent) and a (100) plane as the principal plane.

Subsequently, desalting was carried out employing modified gelatin (in which the amino group of said gelatin was substituted with phenylcarbamyl, such as, for example, exemplified compound G-8 described in JP O.P.I. No. 2-280139), which is described in JP O.P.I. No. 2-280139. After said desalting, the EAg was 190 mV at 50° C.

Added to the obtained emulsion was $1\times10^{-3}$ mole of 4-hydroxy-6-methyl-1,3,3a,7-tetraazaindene (ST-1) per mole of silver, and by adding potassium bromide and citric acid, the pH and the EAg were then adjusted to 5.6 and 123 mV, respectively. After adding $2\times10^{-5}$ mole of chloroauric acid, $3\times10^{-6}$ mole of inorganic sulfur was added and the resultant emulsion underwent chemical ripening at 60° C. until the maximum sensitivity was achieved. After ripening, $2\times10^{-3}$ mole of ST-1 per mole of silver, $3\times10^{-4}$ mole of 1-phenyl-5-mercaptotetrazole (ST-2), and gelatin were added.

(Preparation of Silver Halide Emulsion B)

Employing a double-jet method, prepared were silver chlorobromoiodide core grains comprised of 60 mole percent of silver chloride, 37.5 mole percent of silver bromide, and 2.5 mole percent of silver iodide at an average thickness of 0.05 μm and an average diameter of 0.15 μm. While mixing said core grains, $2\times10^{-7}$ mole of $K_3IrCl_6$ per mole of silver was added. Said core grains were covered with shells, employing a double-jet method. At that time, $3\times10^{-7}$ mole of $K_2IrCl_6$ per mole of silver was added.

The obtained emulsion was a core/shell type monodispersed tabular grain silver chlorobromoiodide (comprised of 90 mole percent of silver chloride, 0.5 mole percent of silver iodide, and 9.5 mole percent of silver bromide) emulsion at an average thickness of 0.10 μm and an average diameter of 0.42 μm (having a variation coefficient of 10 percent).

Subsequently, the obtained emulsion was desalted employing the same modified gelatin as that used in the preparation of Emulsion A. After desalting, the EAg was 180 mV at 50° C.

Added to the obtained emulsion was $1\times10^{-3}$ mole of ST-1 per mole of silver, and by adding potassium bromide and citric acid, the pH and the EAg were then adjusted to 5.6 and 123 mV, respectively. After adding $2\times10^{-5}$ mole of chloroauric acid, $3\times10^{-5}$ mole of N,N,N'-trimethyl-N'-heptafluoroheptylselenourea was added and the resultant emulsion underwent chemical ripening at 60° C. until the maximum sensitivity was achieved. After ripening, $2\times10^{-3}$ mole of ST-1 per mole of silver, $3\times10^{-4}$ mole of ST-2, and gelatin were added.

(Preparation of Light-sensitive Material for a Printing Process Scanner)

Simultaneous multilayer coating was carried out in such a manner that applied onto one side of the sublayer of the aforementioned support was a gelatin sublayer of Formula 1, described below, to obtain a coated gelatin amount of 0.5 g/m; applied onto the resultant layer was Silver Halide Emulsion Layer 1 of Formula 2 described below to obtain a coated silver amount of 1.5 g/m and a coated gelatin amount of 0.5 g/m$^2$; further, applied onto the resultant layer was a coating composition of Formula 3 as the intermediate protective layer to obtain a coated gelatin amount of 0.3 g/m$^2$; still further applied onto the resultant layer was Silver Halide Emulsion Layer 2 of Formula 4 to obtain a coated silver amount of 1.4 g/m$^2$ and a coated gelatin amount of 0.6 g/m$^2$; and yet further was applied a coating composition of Formula 5 to obtain a coated gelatin amount to of 0.6 g/m$^2$. In addition, simultaneous multilayer coating was carried out in such a manner that applied onto the sublayer of the opposite side was a backing layer of Formula 6 to obtain a coated gelatin amount of 0.6 g/m$^2$; applied onto the resultant layer was a hydrophobic polymer layer of Formula 7; and further applied onto the resultant layer was a backing protective layer of Formula 8 to obtain a coated gelatin amount of 0.4 g/m$^2$. Thus a light-sensitive material sample was obtained. Further, the numerical figures in each formula mean the coated amount per m$^2$ of the light-sensitive material.

Formula 1 (Composition of Gelatin Sublayer)

| | |
|---|---|
| Gelatin | 0.5 g |
| Fine solid dispersed particles of Dye AD-1 (having an average particle diameter of 0.1 μm) | 25 mg |
| Sodium polystyrenesulfonate | 10 mg |
| Surface Active Agent Su-1 | 0.4 mg |

Formula 2 (Composition of Silver Halide Emulsion Layer 1)

| | |
|---|---|
| Silver Halide Emulsion A to obtain a silver amount of 1.5 g | |
| Fine solid dispersed particles of Dye AD-8 (having an average particle diameter of 0.1 μm) | 20 mg |
| Cyclodextrin (hydrophilic polymer) | 0.5 g |
| Sensitizing Dye d-1 | 5 mg |
| Sensitizing Dye d-2 | 5 mg |
| Quaternary Onium Compound P-34 | 40 mg |
| Redox Compound RE-1 | 20 mg |
| Surface Active Agent "e" | 100 mg |
| Latex Polymer "f" | 0.5 g |
| Hardener g-1 | 5 mg |
| Surface Active Agent Su-1 | 0.7 mg |
| 2-Mercapto-6-hydroxypurine (stabilizer) | 5 mg |
| EDTA | 30 mg |
| Colloidal silica (having an average particle diameter of 0.05 μm) | 10 mg |

Formula 3 (Intermediate Protective Layer)

| | |
|---|---|
| Gelatin | 0.3 g |
| Surface Active Agent Su-1 | 2 mg |

Formula 4 (Composition of Silver Halide Emulsion Layer 2)

| | |
|---|---|
| Silver Halide Emulsion B to obtain a silver amount of 1.4 g | |
| Sensitizing Dye d-1 | 3 mg |
| Sensitizing Dye d-2 | 3 mg |
| Quaternary Onium Compound P-10 | 40 mg |
| Redox Compound RE-2 | 20 mg |
| 2-Mercapto-6-hydroxypurine (stabilizer) | 5 mg |
| EDTA | 20 mg |
| Latex Polymer "f" | 0.5 g |
| Surface Active Agent Su-1 | 1.7 mg |

Formula 5 (Composition of Emulsion Protective Layer)

| | |
|---|---|
| Gelatin | 0.6 g |
| Fine solid dispersed particles of Dye AD-5 (having an average particle diameter of 0.1 μm) | 40 mg |
| Surface Active Agent Su-1 | 12 mg |

-continued

| | |
|---|---|
| Matting agent (monodispersed silica having an average particle diameter of 3.5 μm) | 25 mg |
| Hardener g-2 | 40 mg |
| Surface Active Agent "h" | 1 mg |
| Colloidal silica (having an average particle diameter of 0.05 μm) | 10 mg |
| Hardener K-2 | 30 mg |

Formula 6 (Composition of Backing Layer)

| | |
|---|---|
| Gelatin | 0.6 g |
| Surface Active Agent Su-1 | 5 mg |
| Latex Polymer "f" | 0.3 g |
| Colloidal silica (having an average particle diameter of 0.05 μm) | 70 mg |
| Sodium polystyrenesulfonate | 20 mg |
| Cross Linking Agent "i" | 100 mg |

Formula 7 (Composition of Hydrophobic Polymer Layer)

| | |
|---|---|
| Latex (methyl methacrylate:acrylic acid = 97:3) | 1.0 g |
| Hardener g-1 | 6 mg |

Formula 8 (Backing Protective Layer)

| | |
|---|---|
| Gelatin | 0.4 g |
| Matting agent (monodispersed PMMA having an average particle diameter of 5 μm) | 50 mg |
| Surface Active Agent Su-2 | 10 mg |
| Surface Active Agent "h" | 1 mg |
| Dye "k" | 20 mg |
| $H(OCH_2CH_2)_{68}OH$ | 50 mg |
| Hardener K-2 | 20 mg |

Su-1: sodium i-amyl-decylsulfosuccinate
Surface Active Agent "e": p-nonylphenol-ethyleneoxide 35-mole addition product
Hardener g-l: 2,4-dichloro-6-hydroxy-s-triazine sodium
EDTA: ethylenediamine tatraacetic acid
Hardener g-2: 1,3-bisulfonyl-2-propoanol
Surface Active Agent "h": sodium p-heptadecylfluorononyloxybenzenesulfonate
PMMA: polymethyl methacrylate
Su-2: sodium di(2-ethylhexyl)sulfosuccinate Sensitizing Dye d-1

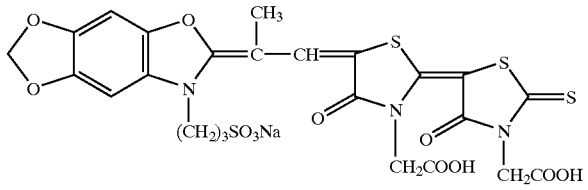

-continued
Sensitizing Dye d-2
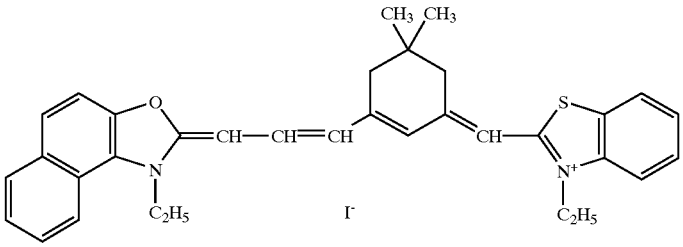
Latex Polymer "f"
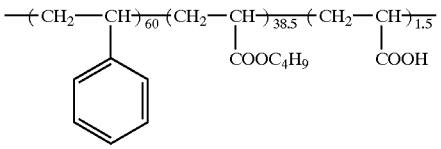
AD-1
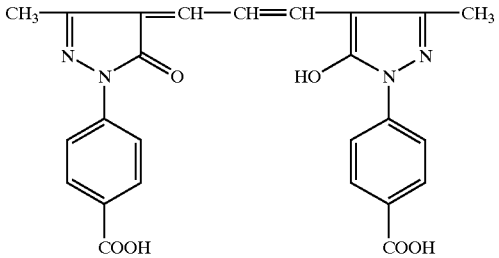
AD-5
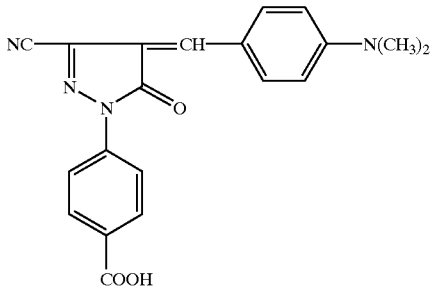
AD-8
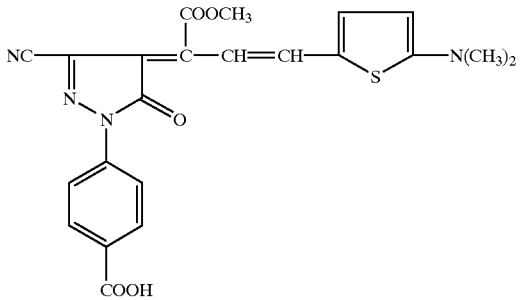
Cross Linking Agent "i"
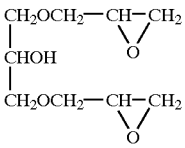

-continued

Dye "k"

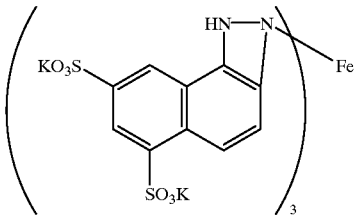

RE-1

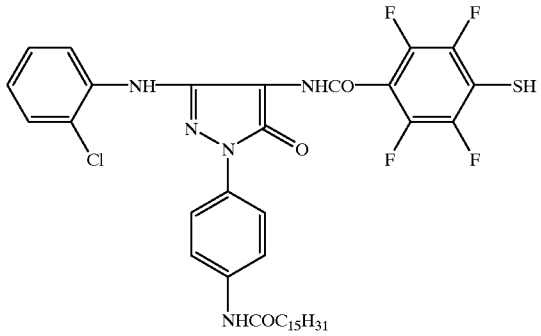

RE-2

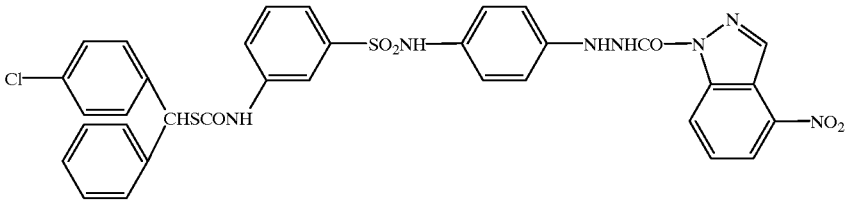

K-2

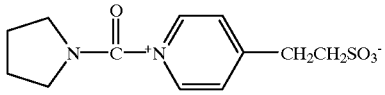

Incidentally, the surface resisitivity on the backing side after drying was $6\times10^{11}$ at 23° C. and RH 20 percent, and the pH of the layer surface on the emulsion side was 5.5.

The same evaluation as Example 1 was carried out employing the solid developer as well as the concentrated developer employed in Example 1. Table 3 shows the results. It is found that in the same manner as Example 1, the present invention exhibits desired effects.

TABLE 3

| | | Solid Developer | | Solid Fixer | | | Processing | Water | | |
|---|---|---|---|---|---|---|---|---|---|---|
| Experiment No. | Light-sensitive Material | No. | Compound of the Invention | Boric Acid (kg) | Crystallization Retarder | FB Filled Amount (g) | Unevenness | Washing Tank Deposit | Roller Stain | Remarks |
| 301 | Example 3 | 11 | (1)-1 | 21.61 | — | 192.6 | 1 | 2 | 2 | Comp. |
| 302 | Example 3 | 11 | (1)-1 | 21.61 | Na gluconate | 212.6 | 1 | 2 | 2 | Comp. |
| 303 | Example 3 | 11 | (1)-1 | 10.81 | Na gluconate | 182.6 | 2 | 2 | 2 | Comp. |
| 304 | Example 3 | 11 | (1)-1 | — | Na gluconate | 142.6 | 4 | 5 | 5 | Inv. |
| 305 | Example 3 | 11 | (1)-1 | — | Na gluconate | 152.6 | 5 | 5 | 5 | Inv. |
| 306 | Example 3 | 12 | — | — | Na gluconate | 152.6 | 2 | 4 | 4 | Comp. |
| 307 | Example 3 | 11 | (1)-1 | — | Na glycolate | 152.6 | 5 | 5 | 5 | Inv. |
| 308 | Example 3 | 13 | (1)-3 | 21.61 | — | 192.6 | 1 | 2 | 2 | Comp. |

TABLE 3-continued

| Experiment No. | Light-sensitive Material | Solid Developer No. | Solid Developer Compound of the Invention | Solid Fixer Boric Acid (kg) | Solid Fixer Crystallization Retarder | Solid Fixer FB Filled Amount (g) | Processing Unevenness | Water Washing Tank Deposit | Roller Stain | Remarks |
|---|---|---|---|---|---|---|---|---|---|---|
| 309 | Example 3 | 13 | (1)-3 | 21.61 | Na gluconate | 212.6 | 2 | 2 | 2 | Comp. |
| 310 | Example 3 | 13 | (1)-3 | 10.81 | Na gluconate | 182.6 | 2 | 2 | 2 | Comp. |
| 311 | Example 3 | 13 | (1)-3 | — | Na gluconate | 142.6 | 4 | 5 | 5 | Inv. |
| 312 | Example 3 | 13 | (1)-3 | — | Na gluconate | 152.6 | 5 | 5 | 5 | Inv. |
| 313 | Example 3 | 12 | — | — | Na gluconate | 152.6 | 1 | 3 | 3 | Comp. |
| 314 | Example 3 | 13 | (1)-3 | — | Na glycolate | 152.6 | 5 | 5 | 5 | Inv. |
| 315 | Example 3 | 14 | (1)-5 | — | Na gluconate | 152.6 | 5 | 5 | 5 | Inv. |

Comp.: comparative,
Inv.: present invention

Example 4

Processing, which was the same ass Example 2, was carried out employing the light-sensitive material used in Example 3, the solid developers used in Example 2, and the solid fixers used in Example 1, and evaluation was carried out in the same manner as Example 2. Table 4 shows the results. It is found that the present invention exhibits effects in the same manner as Example 2.

TABLE 4

| Experiment No. | Light-sensitive Material | Solid Developer No. | Solid Developer Compound of the Invention | Solid Fixer Boric Acid (kg) | Solid Fixer Crystallization Retarder | Solid Fixer FB Filled Amount (g) | Processing Unevenness | Water Washing Tank Deposit | Roller Stain | Remarks |
|---|---|---|---|---|---|---|---|---|---|---|
| 401 | Example 3 | 21 | (1)-1 | 21.61 | — | 192.6 | 2 | 2 | 2 | Comp. |
| 402 | Example 3 | 21 | (1)-1 | 21.61 | Na gluconate | 212.6 | 2 | 2 | 2 | Comp. |
| 403 | Example 3 | 21 | (1)-1 | 10.81 | Na gluconate | 182.6 | 2 | 2 | 2 | Comp. |
| 404 | Example 3 | 21 | (1)-1 | — | Na gluconate | 142.6 | 4 | 5 | 5 | Inv. |
| 405 | Example 3 | 21 | (1)-1 | — | Na gluconate | 152.6 | 4 | 5 | 5 | Inv. |
| 406 | Example 3 | 22 | — | — | Na gluconate | 152.6 | 2 | 4 | 4 | Comp. |
| 407 | Example 3 | 21 | (1)-1 | — | Na glycolate | 152.6 | 4 | 5 | 5 | Inv. |
| 408 | Example 3 | 23 | (1)-3 | 21.61 | — | 192.6 | 3 | 2 | 2 | Comp. |
| 409 | Example 3 | 23 | (1)-3 | 21.61 | Na gluconate | 212.6 | 3 | 2 | 2 | Comp. |
| 410 | Example 3 | 23 | (1)-3 | 10.81 | Na gluconate | 182.6 | 3 | 2 | 2 | Comp. |
| 411 | Example 3 | 23 | (1)-3 | — | Na gluconate | 142.6 | 4 | 5 | 5 | Inv. |
| 412 | Example 3 | 23 | (1)-3 | — | Na gluconate | 152.6 | 4 | 5 | 5 | Inv. |
| 413 | Example 3 | 22 | — | — | Na gluconate | 152.6 | 2 | 4 | 3 | Comp. |
| 414 | Example 3 | 23 | (1)-3 | — | Na glycolate | 152.6 | 4 | 5 | 5 | Inv. |
| 415 | Example 3 | 24 | (1)-5 | — | Na gluconate | 152.6 | 4 | 5 | 5 | Inv. |

Comp.: comparative,
Inv.: present invention

Example 5

(Preparation of Light-sensitive Material)

(Preparation of Silver Halide Emulsion A)

An aqueous silver nitrate solution and an aqueous halide solution comprised of NaCl and KBr were added to solution A at a pH of 3, a temperature of 40° C., and a constant flow rate for 30 minutes, employing a double jet method, and 0.20 μm cubic crystals comprised of 70 mole percent of AgCl and 30 mole percent of AgBr were obtained. During said addition, the silver potential (EAg) was 160 mV at the start of mixing and decreased to 100 mV at the completion of mixing. Thereafter, unnecessary salts were removed employing ultrafiltration. Then, 15 g of gelatin per mole of silver were added, and the pH was adjusted to 5.7. Thereafter, the resultant mixture was dispersed at 55° C. for 30 minutes. After said dispersion, $4\times10^{-4}$ mole of Chloramin T per mole of silver was added. The silver potential of the finished emulsion was 190 mV (at 40° C.).

| | | |
|---|---|---|
| A: | Ossein gelatin | 25 g |
| | Nitric acid (5%) | 6.5 ml |
| | Deionized water | 700 ml |
| | Na $[RhCl_5(H_2O)]$ | 0.02 ml |
| B: | Silver nitrate | 170 g |
| | Nitric acid (5%) | 4.5 ml |
| | Deionized water | 200 ml |
| C: | NaCl | 47.5 g |
| | KBr | 51.3 g |
| | Ossein gelatin | 6 g |
| | $Na_3$ $[IrCl_6]$ | 0.15 mg |
| | Deionized water | 200 ml |

Added to the obtained emulsion were, per mole of silver, $1.5\times10^{-3}$ mole of 4-hydroxy-methyl-1,3,3a,7-tatraazaindene and $8.5\times10^{-4}$ mole of potassium bromide, and then the pH and the EAg were adjusted to 5.6 and 123 mV, respectively. Then $2\times10^{-6}$ mole of flowers of sulfur in terms of the sulfur atoms and $1.5\times10^{-5}$ mole of chloroauric acid were added to the resultant mixture followed by chemical ripening at 50° C. for 80 minutes. Thereafter, added to the ripened emulsion were, per mole of silver, $2\times10^{-3}$ mole of 4-hydroxy-methyl-1,3,3a,7-tatraazaindene, $3\times10^{-4}$ mole of 1-phenyl-5-mercaptotetrazole, and $1.5\times10^{-3}$ mole of potassium iodide. After cooling the resultant mixture to 40° C., $4\times10^{-4}$ mole of sensitizing dye, S-1, per mole of silver was added.

Employing the emulsion prepared as described above, the first layer, the second layer, and the third layer described below, from the support side, were simultaneously applied onto one side of a subbed support so as to obtain the coated amount per $m^2$ as described in the formulas below, and subsequently cool-set. Thereafter, employing the dye formula described below, a backing layer was applied onto the sublayer having an antistatic layer on the opposite side, and subsequently cool-set at −1° C. Both sides were simultaneously dried to obtain a sample.

(Sublayer)

After applying corona discharge of 30 $W/m^2$.minute to both surfaces of a biaxially stretched polyethylene terephthalate support (having a thickness of 100 μm), the sublayer having the composition described below was applied onto both sides of said support, and subsequently dried at 100° C. for one minute.

| | |
|---|---|
| 2-Hydroxyethyl methacrylate (25)-butyl acrylate (30)-t-butyl acrylate (25)-styrene (20) copolymer (figures show the weight ratio) | 0.5 $g/m^2$ |
| Surface active agent A | 3.6 $mg/m^2$ |
| Hexamethylene-1,6-bis(ethylene urea) | 10 $mg/m^2$ |

(Antistatic Layer)

After applying corona discharge of 10 $W/m^2$·minute onto a subbed polyethylene terephthalate support, an antistatic layer having the composition described below was applied onto one side of said support at a speed of 70 m/minute, employing a roll-fit coating pan as well as an air knife, and subsequently dried at 90° C. for two minutes. The resultant coated layer was subjected to thermal treatment at 140° C. for 90 seconds.

| | |
|---|---|
| Water-soluble electrically conductive polymer B | 0.6 $g/m^2$ |
| Hydrophobic polymer particle C | 0.4 $g/m^2$ |
| Polyethylene oxide compound (having a Mw of 600) | 0.1 $g/m^2$ |
| Hardener E | 0.08 $g/m^2$ |

(Emulsion Layer)

| | |
|---|---|
| First Layer | |
| Gelatin | 0.30 $g/m^2$ |
| 1-Phenyl-4-methyl-4-hydroxymerhyl 3-pyrazolidone | 0.005 $g/m^2$ |
| Sodium isoamyl-n-decylsulfosuccinate | 0.005 $g/m^2$ |
| Sodium dococylbenezenesulfonate | 0.02 $g/m^2$ |
| 2-Methylhydroquinone | 0.10 $g/m^2$ |
| AM | 0.05 $g/m^2$ |
| Polystyrenesulfonic acid (having a Mw of 500,000) | 0.02 $g/m^2$ |
| Second Layer: | |
| Gelatin | 1.0 $g/m^2$ |
| Silver halide emulsion A with a silver amount of | 3.3 $g/m^2$ |
| Hydrazine compound H-34 | 0.015 $g/m^2$ |
| Hydrazine compound H-39 | 0.020 $g/m^2$ |
| Nucleation promoting agent Na-21 | 0.15 $g/m^2$ |
| 5-Nitroindazol | 0.01 $g/m^2$ |
| 2-Mercaptohypoxanthine | 0.02 $g/m^2$ |
| Polymer suspension comprised of 75 percent by weight of colloidal silica, 12.5 percent by weight of vinyl acetate, and 12.5 percent by weight of vinyl pivalinate | 1.4 $g/m^2$ |
| Polymer latex L1 (having a particle diameter of 0.10 μm) | 0.5 $g/m^2$ |
| Dextran (having an average molecular weight of 40,000) | 0.1 $g/m^2$ |
| Surface active agent | 0.09 $g/m^2$ |
| 4-Mercapto-3,5,6-fluorophthalic acid | 0.05 $g/m^2$ |
| Sodium polystyrenesulfonate (having an average molecular weight of 500,000) | 0.015 $g/m^2$ |
| The pH of the coating composition was 5.2. | |
| Third Layer: | |
| Gelatin | 0.50 $g/m^2$ |
| Dextran (having an average molecular weight of 40,000) | 0.2 $g/m^2$ |
| Colloidal silica | 0.10 $g/m^2$ |
| Surface active agent SU-2 | 0.02 $g/m^2$ |

-continued

| | |
|---|---|
| Sodium dihexylsulfosuccinate | 0.010 g/m$^2$ |
| Disinfectant Z | 0.005 g/m$^2$ |
| Hardener (1) | 0.07 g/m$^2$ |
| Polymethyl methacrylate latex (having a size of 3 $\mu$m) | 0.01 g/m$^2$ |
| (Backing Layer) | |
| Gelatin | 2.0 g/m$^2$ |
| F-2 | 0.035 g/m$^2$ |
| F-3 | 0.1 g/m$^2$ |
| Sodium dihexylsulfosuccinate | 0.020 g/m$^2$ |
| Polymer suspension comprised of 75 percent by weight of colloidal silica, 12.5 percent by weight of vinyl acetate, and 12.5 percent by weight of vinyl pivalinate | 0.7 g/m$^2$ |
| Sodium polystyrenesulfonate | 0.010 g/m$^2$ |
| Matting agent (monodispersed polymethyl methacrylate having an average particle diameter of 3 $\mu$m) | 0.045 g/m$^2$ |
| Hardener (1) | 0.05 g/m$^2$ |
| Hardener (2) | 0.07 g/m$^2$ |

S-1

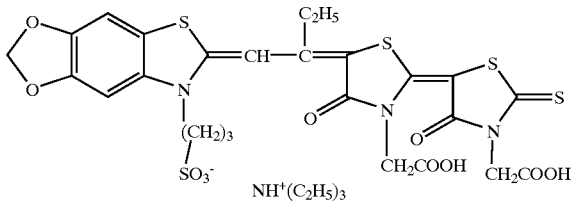

L1

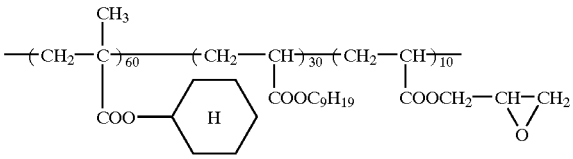

SU-1

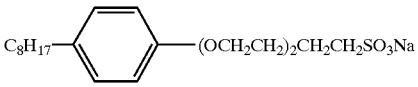

SU-2

$C_7F_{15}CH_2(OCH_2CH_2)_{13}OH$

AM

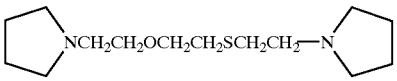

Hardener (1)

$(CH_2{=}CHSO_2CH_2CONHCH_2)_2$

Hardener (2)

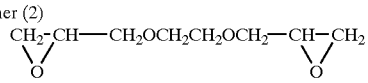

Disinfectant Z

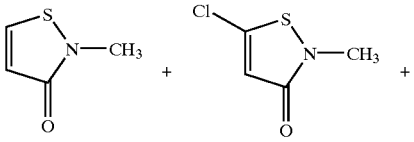

-continued

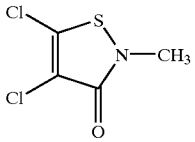

Water-soluble electrically conductive polymer B

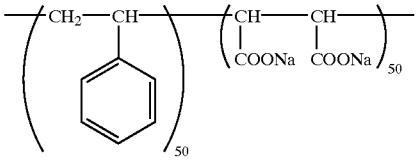

Hydrophobic polymer particle C

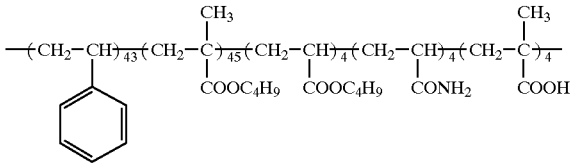

Hardener E

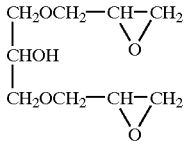

Surface Active Agent A

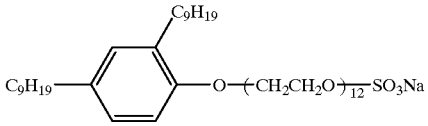

F-2

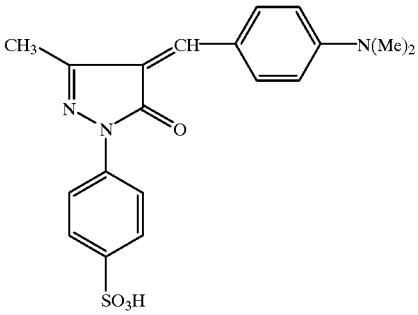

F-3

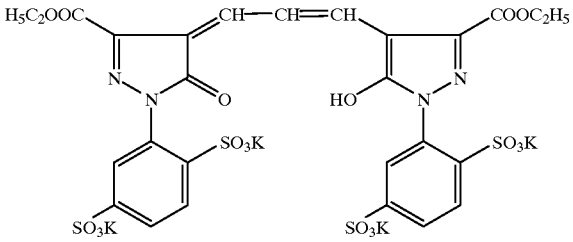

(Preparation of Developer)

(Preparation of Solid Developer 103 (equivalent to 10 liters))

1) Preparation of Developing Agent Granule DA

Pretreatment of Components

Hydroquinone was pulverized at a mesh of 8 mm and a rotation frequency of 25 Hz, employing a Mikro-Pulverizer AP-B, manufactured by HOSOKAWA MICRON CORP. KBr was sized to a mesh of 0.25 mm, employing a commercially available sizer.

Blending of Components

The components described below were blended for 15 minutes employing a commercially available V-type blender (having a capacity of 200 liters).

| | |
|---|---|
| Hydroquinone (said pulverized one) | 42.57 kg |
| Sodium erithorbinate (manufactured by Feizer) | 10.64 kg |
| Dimezone-S | 2.31 kg |
| Compound (1)-1 of the present invention | 0.05 kg |
| DTPA.5H | 7.09 kg |
| KBr (said sized one) | 3.55 kg |
| Benzotriazole | 0.51 kg |
| Sorbitol | 3.14 kg |

From randomly selected points (5 locations) of the obtained mixture, 50 g from each location was individually sampled and analyzed. As a result, it was found that the concentration of each component was within ±1 percent of said formula value and blending was considered to have been carried out sufficiently and uniformly.

Molding

Said mixture was molded under conditions of a pocket shape of 5.0 Φmm×1.2 mm (in depth), a rotation frequency of the roller of 15 rpm, and a rotation frequency of the feeder of 24 rpm, employing a compression granulator Briquetter BSS-IV Type, manufactured by Shinto Kogyo Co., Ltd. The obtained plate shaped mold was granulated employing a sizer to classify 2.4 to 7.0 mm granules and 2.4 mm or less fine granules (while 7.00 mm or more granules were regranulated). The 2.4 mm or less granules were blended into said mixture and the resultant mixture was returned to a compression molding machine and remolded. According to the method described above, about 68 kg of developing agent granule DA were obtained.

2) Preparation of Alkali Granule DB

Preparation of Components

Dissolved in 400 ml of ethyl alcohol were 556 g of 1-phenyl-5-mercaptotetrazole. A small amount of the resultant solution was dripped into 20 kg of anhydrous sodium carbonate which was rotated employing a mixer, and the rotation was continued until the mixture was sufficiently dried. From randomly selected points (5 locations) of the obtained mixture, 10 g from each location was individually sampled and subsequently analyzed. Then it was considered that 1-phenyl-5-mercaptotetrazole was sufficiently and uniformly mixed. The obtained mixture was designated as M-1.

Blending of Potassium Carbonate/M-1/Sodium Octanesulfonate The components described below were blended for 10 minutes employing a commercially available V type blender (having a capacity of 200 liters).

| | |
|---|---|
| Potassium carbonate | 14.85 kg |
| M-1 | 11.44 kg |
| anhydrous sodium sulfite | 35.85 kg |
| D-mannitol | 4.63 kg |
| D-sorbitol | 1.86 kg |

After blending, 1.37 kg of sodium 1-octanesulfonate were added and blended for further 5 minutes.

Molding

Said mixture was molded under conditions of a pocket shape of 5.0 Φmm×1.2 mm (in depth), a rotation frequency of the roller of 15 rpm, and a rotation frequency of the feeder of 44 rpm, employing a compression granulator Briquetter BSS-IV Type, manufactured by Shinto Kogyo Co., Ltd. The obtained plate shaped mold was granulated employing a sizer to classify 2.4 to 7.0 mm granules and 2.4 mm or less fine granules (while 7.00 mm or more granules were granulated). The 2.4 mm or less granules were blended into said mixture and the resultant mixture was returned to a compression molding machine and remolded. According to the method described above, about 68 kg of alkali granule DB were obtained.

Packaging (10-liter kit of working solution)

A 10-liter capped polyethylene bottle was filled with molded granules and $LiOH \cdot H_2O$ in the order described below. In order to minimize degradation due to aerial oxidation, 10 liters of nitrogen gas was introduced into the bottle, which was then sealed with the cap to obtain packaged solid developer 103.

| | |
|---|---|
| $LiOH.H_2O$ | 750.0 g |
| DB | 1174.9 g |
| DA | 355.2 g |

Solid Developers 104 and 105 were prepared in the same manner as Solid Developer 103, except that the compound of the present invention was replaced as shown in Table 5.

(Preparation of Concentrated Developer 101 (for 10 liters))

| | |
|---|---|
| Pure water | 3.0 liters |
| DTPA.5H | 36 g |
| Anhydrous sodium sulfite | 601.7 g |
| KBr | 18 g |
| Potassium carbonate | 249.3 g |
| Sodium carbonate | 191.7 g |
| Compound (1)-1 of the present invention | 0.025 g |
| Benzotriazole | 2.59 g |
| Hydroquinone | 216.5 g |
| Dimezone-S | 11.65 g |
| 1-Phenyl-5-mercaptotetrazole | 0.31 g |
| $LiOH.H_2O$ | 75.0 g |
| D-sorbitol | 47.19 g |
| D-mannitol | 77.71 g |
| Sodium 1-octanesulfonate | 22.99 g |

After adjusting the total volume to 5 liters, by adding water, the resultant mixture was placed in the same container in which said granule agent was placed. In order to minimize degradation due to aerial oxidation, 10 liters of nitrogen gas was bubbled into the bottle which was then sealed with its cap to obtained 10 liters of packaged concentrated developer 101. After storing said concentrated developer 101 at 30° C. for one month, a replenisher was prepared. Concentrated developer 102 was prepared in the same manner as concentrated developer 101, except that the compound of the present invention was replaced with (l)-3.

(Preparation of Working Replenisher)

Said solid developer 103 was placed in 9 liters of tap water which was stirred by a commercially available stirrer for about 40 minutes to obtain 10 liters of the replenisher (which was available for the starting solution as well as the replenisher). The pH of the obtained working replenisher was 10.55. By doubly diluting the 10 liters of said concentrated developer 101 by water, a working replenisher was prepared. The pH of the resultant replenisher was 10.55 which was the same as that of the solid developer.

The fixer same as employed in 105 of Example 1 was employed.

(Processing and Evaluation)

Each of the samples of light-sensitive materials, which had been obtained, was exposed employing FTR-3050, manufactured by Dainippon Screen Co., Ltd., and was processed employing an automatic processor LD-T 1060, manufactured by Dainippon Screen Co., Ltd. The processing conditions are described below. The combinations of light-sensitive materials with types of developers are shown in Table 5.

(Processing Conditions)

| | | | |
|---|---|---|---|
| Development | 35° C. | 30 sec | replenishment rate of developer: 120 ml/m$^2$ |
| Fixing | 32° C. | 30 sec | replenishment rate of fixer: 200 ml/m$^2$ |
| Water Washing | normal temperature | 30 sec | washing water rate: 4 L/min |
| Drying | 45° C. | 30 sec | |

For 10 days, continuously processed per day were 610×508 mm 200 sheets, in which 10 percent of the total area of each sheet was exposed. Then, the sensitivity, gamma, black spots, and the adhesion of oily sludge on the light-sensitive material were evaluated.

(Evaluation of Sensitivity and Gamma)

Step exposure was carried out employing a sensitometer utilizing a 660 nm He/Ne laser beam as the light source, while varying the light amount at $1.5\times10^{-7}$ second, and photographic processing was carried out under said processing conditions. The obtained processed sample was measured employing PDA-65 (Konica Digital Densitometer).

In Table 5, the sensitivity was expressed as the relative sensitivity, when the sensitivity of the sample processed by Developer Type 101 was 100 at a density of 2.5. Further, the gamma was expressed employing a tangent of density of 0.1 and 3.0. In Table 5, when the gamma value is 10 or more, it shows that ultra-hard images are obtained.

(Evaluation of Black Spots)

Each of the obtained processed samples was visually evaluated employing a 10 power magnifier , and was graded into 5 ranks of 5, 4, 3, 2, and 1 in the order of decreasing black spots. Ranks 1 and 2 were considered to be commercially unviable. Table 5 shows the obtained results.

(Evaluation of Oily Sludge)

After running processing, unexposed samples were processed and the sample staining was subjected to sensory evaluation based on the ranks described below.

Rank 1: oily sludge adhered the whole area

Rank 2: intermediate between Rank 1 and Rank 3

Rank 3: adhesion was observed, but resulting in no problem for commercial viability Rank 4: intermediate between Rank 3 and Rank 5

Rank 5: no staining was observed.

Ranks 1 and 2 were considered to be not commercially viable. Table 5 shows the obtained results.

TABLE 5

| Developer Type | Compound of the Present Invention | Light-sensitive Material | Starting Solution Sensitivity | Starting Solution Gamma | Starting Solution Black Spots | Running Solution Sensitivity | Running Solution Gamma | Running Solution Black spots | Running Solution Oily Staining | Remarks |
|---|---|---|---|---|---|---|---|---|---|---|
| 103 | (1)-1 | Example 5 | 101 | 11.6 | 5 | 101 | 11.7 | 5 | 5 | Inv. |
| 104 | (1)-3 | Example 5 | 103 | 11.7 | 5 | 102 | 11.6 | 5 | 5 | Inv. |
| 105 | (1)-5 | Example 5 | 100 | 11.5 | 5 | 101 | 11.5 | 5 | 5 | Inv. |

Comp.: comparative,
Inv.: present Invention

Based on the results of Table 5, it is found that by employing the developers of the present invention, neither sensitivity nor gamma decreases, and the adhesion of oily sludge as well as black spots is minimized.

Example 6

Evaluation was carried out in the same manner as Example 5, except that the developer was varied to one (in which ascorbic acid was employed as the developing agent) described below, and further, the processing conditions were varied.

(Preparation of Developer)

(Preparation of Solid Developer 203 (for 10-liter use))

1) Preparation of Developing Agent Granule DA

Pretreatment of Components

Benzotriazole was pulverized at a mesh of 8 mm and a rotation frequency of 25 Hz, employing a MIKURO-PULVERIZER AP-B, manufactured by Hosokawa Micron CORP. KBr was sized to a mesh of 0.25 mm, employing a commercially available sizing machine.

Blending of Components

The components described below were blended for 15 minutes, employing a commercially available V-type blender (having a capacity of 200 liters).

| | |
|---|---|
| L-sodium ascorbate | 69.38 kg |
| Dimezone-S | 2.02 kg |
| Compound (1)-1 of the present invention | 0.03 kg |
| DTPA.5H | 4.63 kg |
| KBr (said sized one) | 5.78 kg |
| Benzotriazole (said sized one) | 0.52 kg |

Blended with said mixture were 2.31 kg of 1-octanesulfonate which had been pulverized at a mesh of 4 mm and a rotation frequency of 60 Hz, employing a MIKURO-PULVERIZER AP-B, manufactured by Hosokawa Micron CORP., and the resultant mixture was further blended for 5 minutes.

From randomly selected points (5 locations) of the obtained mixture, 50 g from each location was individually sampled and analyzed. As a result, it was found that the concentration of each component was within ±1 percent of said formula value and blending was considered to be carried out sufficiently and uniformly.

Molding

Said mixture was molded under conditions of a pocket shape of 5.0 Φmm×1.2 mm (in depth), a rotation frequency -of the roller of 15 rpm, and a rotation frequency of the feeder of 44 rpm, employing a compression granulator Briquetter BSS-IV Type, manufactured by Shinto Kogyo Co., Ltd. The obtained plate shaped mold was granulated employing a sizing machine to classify 2.4 to 7.0 mm granules and 2.4mm or less fine granules (while 7.00 mm or more granules were granulated). The 2.4 mm or less granules were blended into said mixture and the resultant mixture was returned to a compression molding machine and remolded. According to the method described above, about 100 kg of developing agent granule DA were obtained.

Packaging (10-liter kit of working solution)

A 10-liter polyethylene bottle type container with a cap was filled with molded granules and carbonates in the order described below. In order to minimize degradation due to aerial oxidation, 10 liters of nitrogen gas was introduced into the container which was then sealed with the cap to obtain a packaged solid developer 203.

| | |
|---|---|
| Potassium carbonate | 241.9 g |
| Sodium carbonate | 556.4 g |
| DA | 884.8 g |

Solid developers 204 and 205 were prepared in the same manner as solid developer 203, except that the compound of the present invention was replaced with those shown in Table 5.

(Preparation of Concentrated Developer 201 (for 10-liter use))

| | |
|---|---|
| Pure water | 3.0 liters |
| DTPA.5H | 40 g |
| Anhydrous sodium sulfite | 150 g |
| KBr | 50 g |
| Potassium carbonate | 241.9 g |
| Sodium carbonate | 556.4 |
| Compound (1)-1 of the present invention | 0.30 g |
| Benzotriazole | 4.5 g |
| Dimezone-S | 20 g |
| Sodium 1-octanesulfonate | 20 g |

After adjusting the total volume to 5 liters by adding water, the resultant mixture was placed in the same container in which said granule agent was placed. In order to minimize degradation due to aerial oxidation, 10 liters of nitrogen gas was bubbled into the bottle which was then sealed with the cap to obtained 10 liters of concentrated developer 201. After storing said concentrated developer 201 at 30° C. for one month, the replenisher was prepared. Both pHs of the replenisher of solid developer 203 and that of concentrated developer 201 were 10.21.

(Processing and Evaluation)

Evaluation was carried out in the same manner as Example 5, except that the processing conditions were varied to those described below. The combinations of light-sensitive materials with types of developers are shown in Table 6.

| | | | |
|---|---|---|---|
| Development | 38° C. | 15 sec | replenishment rate of developer: 120 ml/m$^2$ |
| Fixing | 32° C. | 15 sec | replenishment rate of fixer: 200 ml/m$^2$ |
| Water Washing | normal temperature | 15 sec | washing water rate: 4 L/min |
| Drying | 45° C. | 15 sec | |

Table 6 shows the results. It is found that the replenishers of the present invention exhibit excellent photographic performance and minimizes oily sludge.

TABLE 6

| Developer Type | Compound of the Present Invention | Light-sensitive Material | Starting Solution Sensitivity | Starting Solution Gamma | Starting Solution Black Spots | Running Solution Sensitivity | Running Solution Gamma | Running Solution Black spots | Running Solution Oily Staining | Remarks |
|---|---|---|---|---|---|---|---|---|---|---|
| 203 | (1)-1 | Example 5 | 100 | 11.6 | 5 | 101 | 11.7 | 5 | 5 | Inv. |
| 204 | (1)-3 | Example 5 | 102 | 11.6 | 5 | 102 | 11.6 | 5 | 5 | Inv. |
| 205 | (1)-5 | Example 5 | 100 | 11.5 | 5 | 101 | 11.6 | 5 | 5 | Inv. |

Comp.: comparative,
Inv.: present Invention

Example 7

(Preparation of Support)

(Synthesis of SPS)

Added to 200 g of toluene were 100 g of styrene, 56 g of triisobutyl aluminum, and 234 g of pentamethylcyclopentadienyl titanium trimethoxide, and the resultant mixture underwent reaction at 96° C. for 8 hours. After removing the catalyst, upon its decomposition, employing a methanol solution of sodium hydroxide, washing was carried out three times employing methanol to obtain 34 g of the target compound.

(Preparation of SPS Film)

The obtained SPS was melt-extruded into a film employing a T die, and then solidified upon rapidly cooling the resultant film on a cooling drum to obtain an unstretched film. At that time, cooling drum receiving speeds were carried out at two stages. The resultant 1370 μm, 1265 μm and 1054 μm thick unstretched films were preheated at 135° C.; longitudinally stretched (by a factor of 3.1); and then laterally stretched (by a factor of 3.4) at 130° C.; and further thermally fixed at 250° C. As a result, 130 μm and 100 μm thick biaxially stretched films, having a bending elastic modulus of $4.41\times10^9$ Pa, were obtained.

(Subcoating of SPS Film)

An adhesive layer comprised of styrene-glycidyl acrylate was formed on said SPS film, and an antistatic layer comprised of a polymer, containing tin oxide sol, was formed on said adhesive layer.

(Preparation of Silver halide Emulsion A)

Employing a double-jet method, prepared were silver chlorobromide core grains comprised of 70 mole percent of silver chloride and 30 mole percent of silver bromide, which had an average thickness of 0.05 μm and an average diameter of 0.15 μm. During mixing said core grains, $8\times10^{-8}$ mole of $K_3RuCl_6$ per mole of silver was added. Said core grains were covered with shells, employing a double-jet method. At that time, $3\times10^{-7}$ mole of $K_2IrCl_6$ per mole of silver was added.

The obtained emulsion was a core/shell type monodispersed tabular grain silver chlorobromoiodide (comprised of 90 mole percent of silver chloride, 0.2 mole percent of silver iodide, and 9.8 mole percent of silver bromide) emulsion, at an average thickness of 0.10 μm and an average diameter of 0.25 μm (having a variation coefficient of 10 percent) and a (100) plane as the principal plane.

Subsequently, desalting was carried out employing modified gelatin (in which the amino group of said gelatin was substituted with phenylcarbamyl, such as, for example, exemplified compound G-8 described in JP O.P.I. No. No. 2-280139), which is described in JP O.P.I. No. No. 2-280139. After said desalting, the EAg was 190 mV at 50° C.

Added to the obtained emulsion was $1\times10^{-3}$ mole of 4-hydroxy-6-methyl-1,3,3a,7-tetraazaindene (ST-1) per mole of silver, and by adding potassium bromide and citric acid, the pH and the EAg were then adjusted to 5.6 and 123 mV, respectively. After adding 2×10–5 mole of chloroauric acid, $3\times10^{-6}$ mole of inorganic sulfur was added and the resultant emulsion underwent chemical ripening at 60° C. until the maximum sensitivity was achieved. After ripening, $2\times10^{-3}$ mole of ST-1 per mole of silver, $3\times10^{-4}$ mole of 1-phenyl-5-mercaptotetrazole (ST-2), and gelatin were added.

(Preparation of Silver Halide Emulsion B)

Employing a double-jet method, prepared were silver chlorobromoiodide core grains comprised of 60 mole percent of silver chloride, 37.5 mole percent of silver bromide, and 2.5 mole percent of silver iodide at an average thickness of 0.05 μm and an average diameter of 0.15 μm. While mixing said core grains, $2\times10^{-7}$ mole of $K_3IrCl_6$ per mole of silver was added. Said core grains were covered with shells, employing a double-jet method. At that time, $3\times10^{-7}$ mole of $K_2IrCl_6$ per mole of silver was added.

The obtained emulsion was a core/shell type monodispersed tabular grain silver chlorobromoiodide (comprised of 90 mole percent of silver chloride, 0.5 mole percent of silver iodide, and 9.5 mole percent of silver bromide) emulsion at an average thickness of 0.10 μm and an average diameter of 0.42 μm (having a variation coefficient of 10 percent).

Subsequently, the obtained emulsion was desalted employing the same modified gelatin as that used in the preparation of Emulsion A. After desalting, the EAg was 180 mV at 50° C.

Added to the obtained emulsion was $1\times10^{-3}$ mole of ST-1 per mole of silver, and by adding potassium bromide and citric acid, the pH and the EAg were then adjusted to 5.6 and 123 mV, respectively. After adding $2\times10^{-5}$ mole of chloroauric acid, $3\times10^{-5}$ mole of N,N,N'-trimethyl-N'-heptafluoroheptylselenourea was added and the resultant emulsion underwent chemical ripening at 60° C. until the maximum sensitivity was achieved. After ripening, $2\times10^{-3}$ mole of ST-1 per mole of silver, $3\times10^{-4}$ mole of ST-2, and gelatin were added.

(Preparation of Light-sensitive Material for a Printing Process Scanner)

Simultaneous multilayer coating was carried out in such a manner that applied onto one side of the sublayer of the aforementioned support was a gelatin sublayer of Formula 1, described below, to obtain a coated gelatin amount of 0.5 $g/m^2$; applied onto the resultant layer was Silver Halide Emulsion Layer 1 of Formula 2 described below to obtain a coated silver amount of 1.5 $g/m^2$ and a coated gelatin amount of 0.5 $g/m^2$; further, applied onto the resultant layer was a coating composition of Formula 3 as the intermediate protective layer to obtain a coated gelatin amount of 0.3 $g/m^2$; still further applied onto the resultant layer was Silver Halide Emulsion Layer 2 of Formula 4 to obtain a coated silver amount of 1.4 $g/m^2$ and a coated gelatin amount of 0.6 $g/m^2$; and yet further was applied a coating composition of Formula 5 to obtain a coated gelatin amount to of 0.6 $g/M^2$. In addition, simultaneous multilayer coating was carried out in such a manner that applied onto the sublayer of the opposite side was a backing layer of Formula 6 to obtain a coated gelatin amount of 0.6 $g/m^2$; applied onto the resultant layer was a hydrophobic polymer layer of Formula 7; and further applied onto the resultant layer was a backing protective layer of Formula 8 to obtain a coated gelatin amount of 0.4 $g/m^2$. Thus a light-sensitive material sample was obtained. Further, the numerical figures in each formula mean the coated amount per $m^2$ of the light-sensitive material.

Formula 1 (Composition of Gelatin Sublayer)

| | |
|---|---|
| Gelatin | 0.5 g |
| Fine solid dispersed particles of Dye AD-1 (having an average particle diameter of 0.1 μm) | 25 mg |
| Sodium polystyrenesulfonate | 10 mg |
| Surface Active Agent Su-1 | 0.4 mg |

Formula 2 (Composition of Silver Halide Emulsion Layer 1)

| | |
|---|---|
| Silver Halide Emulsion A to obtain a silver amount of 1.5 g | |
| Fine solid dispersed particles of Dye AD-8 (having an average particle diameter of 0.1 μm) | 20 mg |
| Cyclodextrin (hydrophilic polymer) | 0.5 g |
| Sensitizing Dye d-1 | 5 mg |
| Sensitizing Dye d-2 | 5 mg |
| Quaternary Onium Compound P-34 | 40 mg |
| Redox Compound RE-1 | 20 mg |
| Surface Active Agent "e" | 100 mg |
| Latex Polymer "f" | 0.5 g |
| Hardener g-1 | 5 mg |
| Surface Active Agent Su-1 | 0.7 mg |
| 2-Mercapto-6-hydroxypurine (stabilizer) | 5 mg |
| EDTA | 30 mg |
| Colloidal silica (having an average particle diameter of 0.05 μm) | 10 mg |

Formula 3 (Intermediate Protective Layer)

| | |
|---|---|
| Gelatin | 0.3 g |
| Surface Active Agent Su-1 | 2 mg |

Formula 4 (Composition of Silver Halide Emulsion Layer 2)

| | |
|---|---|
| Silver Halide Emulsion B to obtain a silver amount of 1.4 g | |
| Sensitizing Dye d-1 | 3 mg |
| Sensitizing Dye d-2 | 3 mg |
| Quaternary Onium Compound P-10 | 40 mg |
| Redox Compound RE-2 | 20 mg |
| 2-Mercapto-6-hydroxypurine (stabilizer) | 5 mg |
| EDTA | 20 mg |
| Latex Polymer "f" | 0.5 g |
| Surface Active Agent Su-1 | 1.7 mg |

Formula 5 (Composition of Emulsion Protective Layer)

| | |
|---|---|
| Gelatin | 0.6 g |
| Fine solid dispersed particles of Dye AD-5 (having an average particle diameter of 0.1 μm) | 40 mg |
| Surface Active Agent Su-1 | 12 mg |
| Matting agent (monodispersed silica having an average particle diameter of 3.5 μm) | 25 mg |
| Hardener g-2 | 40 mg |
| Surface Active Agent "h" | 1 mg |
| Colloidal silica (having an average particle diameter of 0.05 μm) | 10 mg |
| Hardener K-2 | 30 mg |

Formula 6 (Composition of Backing Layer)

| | |
|---|---|
| Gelatin | 0.6 g |
| Surface Active Agent Su-1 | 5 mg |
| Latex Polymer "f" | 0.3 g |
| Colloidal silica (having an average particle diameter of 0.05 μm) | 70 mg |
| Sodium polystyrenesulfonate | 20 mg |
| Cross Linking Agent "i" | 100 mg |

Formula 7 (Composition of Hydrophobic Polymer Layer)

| | |
|---|---|
| Latex (methyl methacrylate:acrylic acid = 97:3) | 1.0 g |
| Hardener g-1 | 6 mg |

Formula 8 (Backing Protective Layer)

| | |
|---|---|
| Gelatin | 0.4 g |
| Matting agent (monodispersed PMMA having an average particle diameter of 5 μm) | 50 mg |
| Surface Active Agent Su-2 | 10 mg |
| Surface Active Agent "h" | 1 mg |
| Dye "k" | 20 mg |
| $H(OCH_2CH_2)_{68}OH$ | 50 mg |
| Hardener K-2 | 20 mg |

Su-1: sodium i-amyl-decylsulfosuccinate

Surface Active Agent "e": p-nonylphenol-ethyleneoxide 35-mole addition product

Hardener g-1: 2,4-dichloro-6-hydroxy-s-triazine sodium

EDTA: ethylenediamine tatraacetic acid

Hardener g-2: 1,3-bisulfonyl-2-propoanol

Surface Active Agent "h": sodium p-heptadecylfluorononyloxybenzenesufonate

PMMA: polymethyl methacrylate

Su-2: sodium di(2-ethylhexyl)sulfosuccinate

Sensitizing Dye d-1

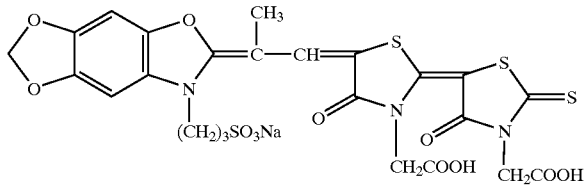

Sensitizing Dye d-2

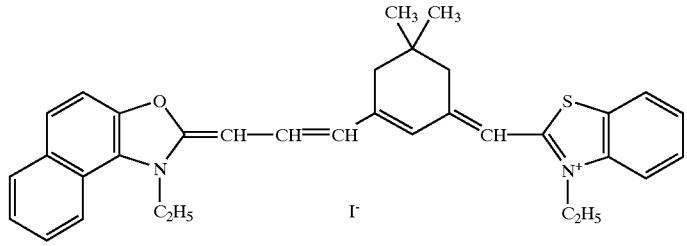

Latex Polymer "f"

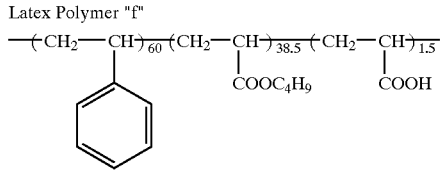

-continued
AD-1
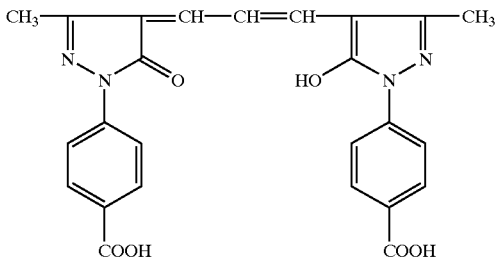
AD-5
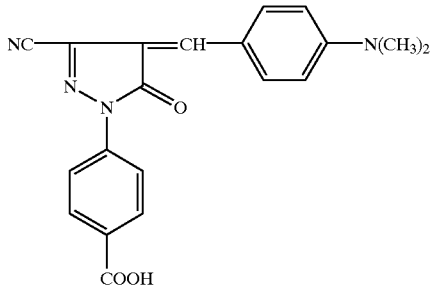
AD-8
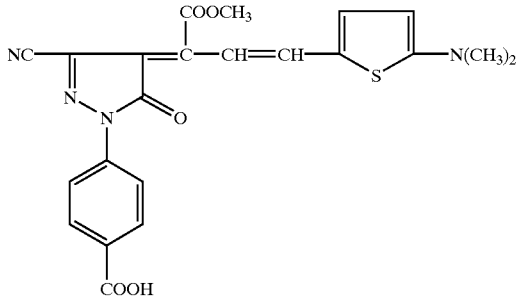
Cross Linking Agent "i"
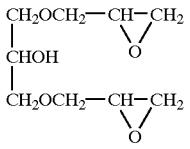
Dye "k"
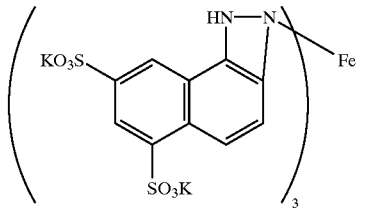

-continued

RE-1

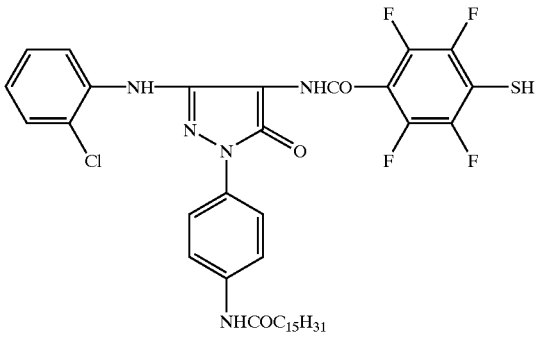

RE-2

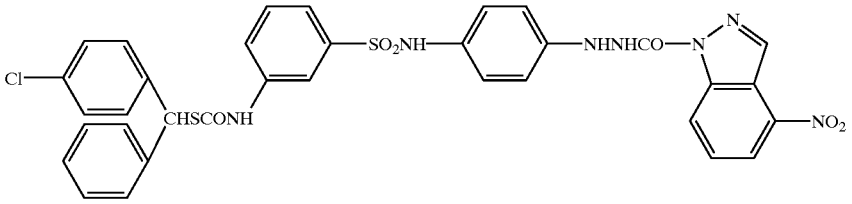

K-2

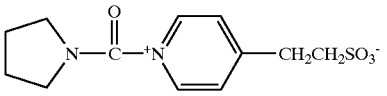

Incidentally, the surface resisitivity on the backing side after drying was $6\times10^{11}$ at 23° C. and RH 20 percent, and the pH of the layer surface on the emulsion side was 5.5.

The same evaluation as Example 5 was carried out employing the solid developer as well as the concentrated developer employed in Example 5. Table 7 shows the results. It is found that in the same manner as Example 5, the present invention exhibits desired effects.

TABLE 7

| Developer Type | Compound of the Present Invention | Light-sensitive Material | Starting Solution Sensitivity | Starting Solution Gamma | Starting Solution Black Spots | Running Solution Sensitivity | Running Solution Gamma | Running Solution Black spots | Running Solution Oily Staining | Remarks |
|---|---|---|---|---|---|---|---|---|---|---|
| 103 | (1)-1 | Example 7 | 103 | 11.4 | 5 | 101 | 11.7 | 5 | 5 | Inv. |
| 104 | (1)-3 | Example 7 | 105 | 11.3 | 5 | 102 | 11.6 | 5 | 5 | Inv. |
| 105 | (1)-5 | Example 7 | 105 | 11.3 | 5 | 101 | 11.5 | 5 | 5 | Inv. |

Comp.: comparative,
Inv.: present Invention

Evaluation was carried out in the same manner as Example 6, employing light-sensitive materials used in Example 7 and the solid developer and the concentrated developer used in Example 6. Table 8 shows the results. The effects of the present invention are found in the same manner as Example 6.

TABLE 8

| Developer Type | Compound of the Present Invention | Light-sensitive Material | Starting Solution Sensitivity | Starting Solution Gamma | Starting Solution Black Spots | Running Solution Sensitivity | Running Solution Gamma | Running Solution Black spots | Running Solution Oily Staining | Remarks |
|---|---|---|---|---|---|---|---|---|---|---|
| 203 | (1)-1 | Example 7 | 100 | 11.5 | 5 | 101 | 11.7 | 5 | 5 | Inv. |
| 204 | (1)-3 | Example 7 | 100 | 11.5 | 5 | 102 | 11.6 | 5 | 5 | Inv. |
| 205 | (1)-5 | Example 7 | 101 | 11.6 | 5 | 101 | 11.5 | 5 | 5 | Inv. |

Comp.: comparative,
Inv.: present Invention

Based on the present invention, it was possible to minimize the staining of the water washing tank as well as the processing unevenness which was caused by the low replenishment rate of a fixer.

According to the present invention, it was possible to provide a method for processing a silver halide light-sensitive photographic material which minimizes the decrease in sensitivity as well as the decrease in contrast, and also minimizes the adhesion of oily sludge onto said light-sensitive material during running processing, employing a replenisher prepared by using a common concentrated solution.

Disclosed embodiment can be varied by a skilled person without departing from the spirit and scope of the invention.

What is claimed is:

1. A method for processing a silver halide light-sensitive photographic material employing an automatic processing machine comprising steps of developing an exposed silver halide light-sensitive photographic material with developer, fixing the developed silver halide light-sensitive photographic material with fixer, washing the fixed silver halide light-sensitive photographic material with washing water, and drying the washed silver halide light-sensitive photographic material, wherein the developer comprises a compound represented by formula (1) in an amount of 0.005 to 0.2 g/l, and the fixer comprises a thiosulfate salt in an effective amount as a fixing agent, a crystallization retarding agent in an amount of 0.005 to 0.2 mol/l and water-soluble aluminum salt in an effective amount as a layer hardener, and substantially comprises no boron compound, Formula (1)

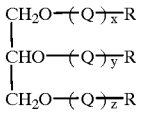

wherein Q represents —$CH_2CH_2$— or —$CH_2CH(J)$—, and J represents a hydrogen atom or an alkyl group, sum of x, y and z is 2 to 4, and R represents

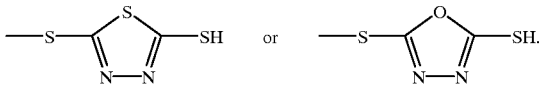

2. The method of claim 1 wherein the crystallization retarding agent is select from a group consisting of gluconic acid, glycolic acid, maleic acid, imidinoacetic acid and 5-sulfosalicyclic acid; and derivative of gluconic acid, glycolic acid, maleic acid, imidinoacetic acid or 5-sulfosalicyclic acid; salt of gluconic acid, glycolic acid, maleic acid, imidinoacetic acid and 5-sulfosalicyclic acid; and salt of derivative of gluconic acid, glycolic acid, maleic acid, imidinoacetic acid or 5-sulfosalicyclic acid.

3. The method of claim 1 wherein the developer comprises hydroquinone as a developing agent.

4. The method of claim 1 wherein the developer comprises ascorbic acid or its salt as a developing agent.

5. The method of claim 1 wherein the developer comprises 3-pyrazolidone or aminophenol compound as a development aid.

6. The method of claim 1 wherein the silver halide light-sensitive photographic material comprises a hydrazine compound and a nucleation promoting agent.

7. The method of claim 1 wherein the silver halide light-sensitive photographic material comprises a quaternary onium compound.

8. The method of claim 1 wherein the fixer is replenished with a fixer replenisher at replenishment rate of 400 $ml/m^2$ or less.

9. The method of claim 1 wherein the developer is replenished with a developer replenisher, which comprises a compound represented by formula (1) and is prepared by employing a solid developer.

10. The method of claim 9 wherein the replenishment rate of the developer replenisher is 250 $ml/m^2$ or less.

11. The method of claim 9 wherein the developer replenisher comprises a carbonate salt in an amount of 0.5 mole/liter or more.

* * * * *